US009400149B2

(12) United States Patent
Potter

(10) Patent No.: US 9,400,149 B2
(45) Date of Patent: Jul. 26, 2016

(54) TOP LOADING SHOTGUN

(71) Applicant: Sturm, Ruger & Company, Inc., Southport, CT (US)

(72) Inventor: Dwight Potter, Unity, NH (US)

(73) Assignee: STURM, RUGER & COMPANY, INC.

( * ) Notice: Subject to any disclaimer, the term of this patent is extended or adjusted under 35 U.S.C. 154(b) by 0 days.

(21) Appl. No.: 14/505,585

(22) Filed: Oct. 3, 2014

(65) Prior Publication Data

US 2015/0096213 A1 Apr. 9, 2015

Related U.S. Application Data

(60) Provisional application No. 61/886,783, filed on Oct. 4, 2013.

(51) Int. Cl.

| | |
|---|---|
| ***F41A 9/41*** | (2006.01) |
| ***F41A 9/72*** | (2006.01) |
| ***F41A 9/23*** | (2006.01) |
| ***F41A 9/40*** | (2006.01) |
| ***F41A 9/48*** | (2006.01) |
| ***F41A 9/82*** | (2006.01) |

(52) U.S. Cl.

CPC ... *F41A 9/72* (2013.01); *F41A 9/23* (2013.01); *F41A 9/40* (2013.01); *F41A 9/41* (2013.01); *F41A 9/48* (2013.01); *F41A 9/82* (2013.01)

(58) Field of Classification Search

CPC ..... F41A 9/72; F41A 9/23; F41A 9/40; F41A 9/41; F41A 9/48; F41A 9/82; F41A 9/54; F42A 9/01

See application file for complete search history.

(56) References Cited

U.S. PATENT DOCUMENTS

| | | | | | |
|---|---|---|---|---|---|
| 88,853 | A * | 4/1869 | Cullen | F41A 3/10 42/24 |
| 1,786,207 | A * | 12/1930 | Hudson | F41A 5/18 42/25 |
| 3,631,621 | A * | 1/1972 | Tito | F41A 3/46 42/17 |
| 3,755,948 | A * | 9/1973 | Heinicke | F41A 9/26 42/106 |
| 3,996,685 | A | 12/1976 | Bauman et al. | |
| 4,270,294 | A * | 6/1981 | Compton | F41A 9/23 42/24 |

(Continued)

FOREIGN PATENT DOCUMENTS

| | | |
|---|---|---|
| EP | 0485137 | 5/1992 |
| WO | 2012005829 | 1/2012 |

OTHER PUBLICATIONS

Corresponding International Search Report and Written Opinion dated Jan. 7, 2015.

*Primary Examiner* — Troy Chambers
*Assistant Examiner* — Bridget Cochran
(74) *Attorney, Agent, or Firm* — The Belles Group, P.C.

(57) ABSTRACT

A shell feeding system for a top loading shotgun in one embodiment includes a barrel, receiver, and a magazine. The magazine includes a cavity configured to receive a plurality of ammunition shells in stacked end-to-end relationship. The magazine is positioned above the barrel and extends forward from the receiver. Shell guide grooves are formed by internal surfaces in the receiver which engage and guide each shell in a feed pathway towards the lower part of the receiver for chambering. A portion of the guide grooves may be arcuately shaped to rotate and reposition the shell for loading by the bolt into the chamber. In one embodiment, the receiver and magazine may be formed as a unitary integral structure formed as either a single piece or in half sections coupled together.

10 Claims, 20 Drawing Sheets

(56) References Cited

U.S. PATENT DOCUMENTS

| | | | | | |
|---|---|---|---|---|---|
| 4,527,459 | A | * | 7/1985 | Childers | F41A 9/16 89/161 |
| 4,676,017 | A | | 6/1987 | Huerlemann et al. | |
| 4,821,442 | A | * | 4/1989 | Bock | F41A 9/72 42/17 |
| 4,856,217 | A | | 8/1989 | Benelli | |
| 5,367,810 | A | * | 11/1994 | Stead | F41A 9/72 42/17 |
| 5,452,533 | A | | 9/1995 | Bentley | |
| 5,675,924 | A | | 10/1997 | Predazzer | |
| 5,771,620 | A | | 6/1998 | Crawford et al. | |
| 5,941,005 | A | | 8/1999 | Battaglia et al. | |
| 6,044,580 | A | | 4/2000 | Gussalli | |
| 6,243,978 | B1 | | 6/2001 | Vignaroli et al. | |
| 6,389,725 | B1 | | 5/2002 | Denuit | |
| 6,397,721 | B1 | | 6/2002 | Murello | |
| 6,564,691 | B2 | | 5/2003 | Butler | |
| 6,739,082 | B2 | | 5/2004 | Christensen | |
| 6,898,888 | B2 | | 5/2005 | Greenhut | |
| 6,966,137 | B2 | | 11/2005 | Beretta | |
| 7,207,130 | B2 | | 4/2007 | Rousseau et al. | |
| 7,356,957 | B1 | | 4/2008 | Jones | |
| 7,380,361 | B2 | | 6/2008 | Hajjar et al. | |
| 7,395,626 | B2 | | 7/2008 | Zedrosser | |
| 7,533,598 | B1 | | 5/2009 | Murphy | |
| 8,061,255 | B1 | | 11/2011 | Boberg | |
| 8,312,656 | B2 | | 11/2012 | Lesenfants | |
| 8,418,390 | B1 | | 4/2013 | Wright | |
| 8,443,712 | B2 | | 5/2013 | Molinari | |
| 2004/0200110 | A1 | | 10/2004 | Greenhut | |
| 2005/0262749 | A1 | | 12/2005 | Rousseau et al. | |
| 2008/0121096 | A1 | | 5/2008 | Hajjar et al. | |
| 2011/0308126 | A1 | | 12/2011 | Lesenfants | |
| 2013/0081314 | A1 | | 4/2013 | Hatfield | |

* cited by examiner

TOP LOADING SHOTGUN

CROSS-REFERENCE TO RELATED APPLICATIONS

The present application claims the benefit of priority to U.S. Provisional Application No. 61/886,783 filed Oct. 4, 2013, the entirety of which is incorporated herein by reference.

BACKGROUND OF THE INVENTION

The present invention generally relates to firearms, and more particularly to a shotgun with top loading shell feed system.

Various type of arrangements are used for storing and feeding shells into the chamber of a shotgun. Some shotguns have tubular-shaped magazines that hold the shells in end-to-end relationship. These magazines are typically mounted below the barrel of the shotgun. The shells are typically advanced rearward out from the magazine in both pump action and auto-loading feed mechanisms towards an open action or breech. From there, the shells are loaded into the chamber at the rear of the barrel and the breech is closed and readied for firing via a trigger-actuated fire control mechanism. After firing, the spent shells are extracted from the chamber and ejected through an external port from the reopened breech. A fresh shell may now be loaded in the foregoing manner.

An improved shell feeding system is desired.

SUMMARY OF THE INVENTION

Exemplary embodiments of the present invention provide an ammunition shell feeding system that operates without a mechanical shell elevator or carrier to load shells from the magazine into the chamber of a shotgun. In one embodiment, the shotgun is a top loading type having the magazine positioned above the barrel. A top loading port allows shells to be manually inserted into the magazine. The shells travel through the receiver to the barrel for chambering via a series of interconnected guide grooves. Advantageously, the shells are advance through the receiver and guide grooves by gravity and assisted by a spring-loaded follower movably disposed in the magazine. This eliminates the need for a shell elevator or carrier to load the chamber.

According to another aspect of the invention, the receiver and magazine may be formed as a single integral part in lieu of separate components. This facilitates fabrication of the shell guide grooves and advantageously reduces manufacturing costs. In one embodiment, the unitary receiver-magazine may be formed in two split halves which can then be assembled. This simplifies formation and molding/casting of the intricate and contoured shell guide grooves.

In one embodiment, a shell feeding system for a top loading shotgun includes a barrel defining a longitudinal axis and an axially extending bore forming a projectile pathway, a receiver supporting the barrel, and an elongated magazine positioned above the barrel and extending axially forward from the receiver. The magazine includes an axially extending cavity configured to receive a plurality of ammunition shells in stacked end-to-end relationship; the shells each having a head and diametrically enlarged rim. A top loading port is provided for loading shells into the magazine. Shell guide grooves are formed by a plurality of internal surfaces in the receiver, the guide grooves including a downwardly and rearwardly angled entrance portion, a central portion, and an exit portion. The guide grooves are configured to guide and feed each shell in a path downward and rearward in the receiver from the magazine into the central portion, and downward and forward from the central portion towards the barrel.

In another embodiment, a shell feeding system for a top loading shotgun includes a barrel defining a longitudinal axis and an axially extending bore forming a projectile pathway, a receiver supporting the barrel, and an elongated magazine positioned above the barrel and extending axially forward from the receiver collectively forming a receiver-magazine assembly. The magazine includes an axially extending cavity configured to receive a plurality of ammunition shells in stacked end-to-end relationship; the shells each having a case, a head, and a diametrically enlarged rim. The receiver-magazine assembly is comprised of a longitudinally split first half and a longitudinally split second half coupled together. The magazine in each of the first and second halves are formed as an integral unitary structural part of the receiver in each of the first and second halves. A spring-biased follower is disposed in the cavity to bias the stack of shells towards the receiver. A plurality of shell guide grooves are formed by internal surfaces in the receiver, the guide grooves forming a shell feed pathway between the magazine and the barrel.

A method for loading ammunition into a top loading shotgun is provided. The method includes: providing a shotgun including a receiver having shell guide grooves, a barrel coupled to the receiver, and a magazine having a tubular body configured to hold a stack of shells arranged in end-to-end relationship, the magazine arranged above the barrel and having a spring-biased follower for urging the stack rearwards toward an open end of the magazine; loading a shell into the magazine in a horizontal position, the shell having a head defining a leading end and a case defining a trailing end; feeding the shell with the leading end first from the magazine rearward into an entrance portion of the shell guide grooves in the receiver; rotating the shell in a first rotational direction downwards into a first angled position, the leading end being lower than the trailing end; moving the shell from the entrance portion into a central portion of the shell guide grooves; rotating the shell in a second rotational direction into a horizontal position; continuing rotating the shell in the second rotational direction upwards into a second angled position, the leading end being higher than trailing end; moving the shell downwards into a lower portion of the receiver; and loading the shell into the barrel. In one embodiment, the central portion of the shell guide grooves has an arcuate shape to rotate the shell from the first angled position into the second angled position.

BRIEF DESCRIPTION OF THE DRAWINGS

The features of the exemplary embodiments will be described with reference to the following drawings where like elements are labeled similarly, and in which.

All drawing shown herein are schematic and not necessarily to scale. Identical parts and features shown and numbered in one drawing shall be construed to have the same number in other drawings where they appear but are not numbered for brevity.

DETAILED DESCRIPTION OF THE INVENTION

Figure 1:
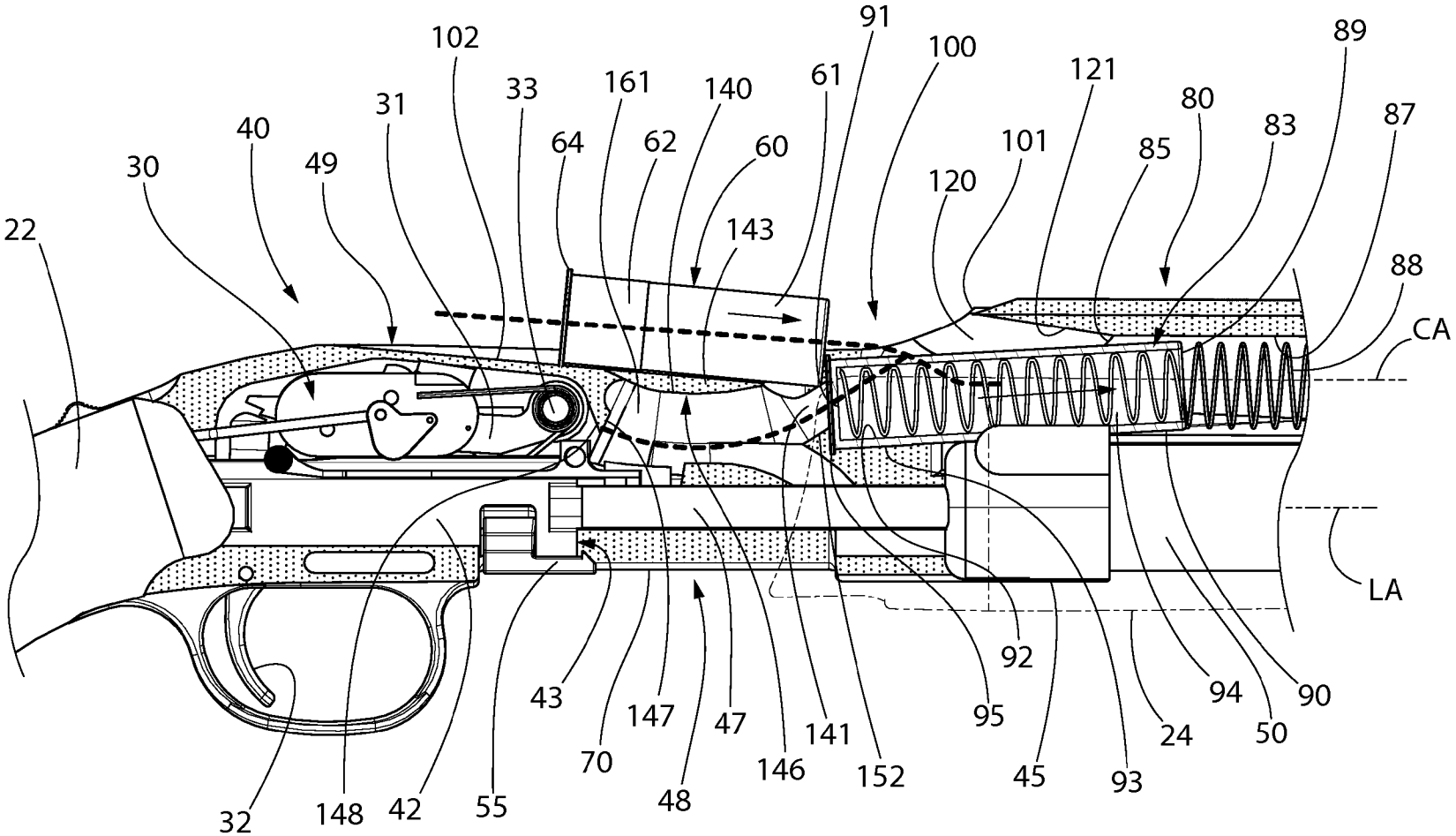
FIGS. 1-13 are right side partial cross-sectional views of one exemplary embodiment of the action portion of a shotgun showing sequential steps for loading/unloading the magazine and chamber according to a shell feeding system of the present disclosure.

The features and benefits of the invention are illustrated and described herein by reference to preferred embodiments. This description of preferred embodiments is intended to be read in connection with the accompanying drawings, which are to be considered part of the entire written description. In the description of embodiments disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation.

Terms such as "attached," "affixed," "connected," "coupled," "interconnected," and similar refer to a relationship wherein structures may be secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

The term "action" is used herein in its conventional sense in the firearm art to connote the mechanism that loads and ejects shells into/from the firearm and opens and closes the breech (i.e. the area in the receiver between an openable/closeable breech face on the front of the bolt and the rear face of barrel chamber).

It should be appreciated that the firearm 20 is exemplary of any of a number of firearms that are suitable for use with the magazine 30. For example, although the firearm 20 is shown with a bolt action, it should be appreciated that the magazine 30 may also be used with other firearms that have other manually actuated actions such as lever actions, pump actions, and the like, as well as firearms that have automatically actuated actions such as semi and fully automatic firearms. In one embodiment, the firearm 20 is a centerfire rifle and the magazine 30 is configured to hold centerfire cartridges.

The figures and description which follows illustrate an exemplary non-limiting shotgun including a top loading shell feed system according to the present disclosure. The present shotgun will be described for convenience with respect to a manual pump-action feed mechanism used to load and unload shells from the chamber. However, the invention is expressly not limited thereto in its applicability and use. Accordingly, embodiments of the present invention may also be used with equal benefit in other type feed mechanisms including without limitation manually-actuated bolt or leverage actions and auto-loading feed mechanisms.

Referring to FIGS. 1-17, shotgun 20 generally includes a stock 22 (aka buttstock), forearm 24, receiver 40, trigger-actuated firing mechanism 30 including a trigger 32 supported by the receiver, a magazine 80 supported by the receiver for holding and dispensing shells, and a barrel 50 supported by the receiver. The receiver 40 includes a lower receiver 48 axially aligned with and supporting the barrel 50 and an upper receiver 49 that pivotally supports the firing mechanism 30 components (e.g. hammer, sear, etc.). Barrel 50 may be attached to receiver 40 in any suitable manner. In one embodiment, barrel 50 may be threadably coupled to the receiver 40.

The receiver 40 forms an internally open chamber 40*a* that houses components of the firing mechanism 30, which may include an axially movable locking bolt 42 defining a breech face 43 on a front end, a spring-biased striker or firing pin 41 carried by the bolt for detonating a chambered ammunition shell 60, a pivotable spring-biased hammer 31 mounted on a lateral pivot pin 33, and other components operable to hold and release the hammer from a cocked position for forming a fully functional trigger-actuated firing and shell loading system. Receiver 40 includes a rear end 44 and front end 45. The receiver may be formed of any suitable material including metallic materials (e.g. aluminum, titanium, steel, etc.) or non-metal (e.g. plastics, composites, etc.).

The stock 22 (only forward portion being shown) is attached to the rear 44 of the receiver 40 such as via a stock bolt or other method. The forearm 24 may be slideably supported by the barrel 50 and/or tubular magazine 80 for forward/rearward movement in the axial direction. The stock 22 and forearm 24 may be made of natural materials (e.g. wood) and/or synthetic materials (e.g. plastic, fiberglass, carbon-graphite composites, etc.).

The barrel 50 has an open rear breech end 51 defining a chamber 53 configured for holding an ammunition shell 60 and an opposite open front muzzle end 52. The area rear of the shell chamber 53 defines an openable/closeable breech in conjunction with the axially movable bolt 42. The barrel 50 has an axially extending bore 54 forming a projectile pathway between the barrel ends. Barrel 50 defines a longitudinal axis LA and corresponding axial direction for shotgun 20. The barrel 50 may be coupled to the front end 45 of the lower receiver 48 in axial alignment with the bolt 42 and firing pin 41 by any suitable means.

In one embodiment, the forearm 24 may be mechanically linked and connected to the bolt 42 by an axially elongated transfer bar 47. The forearm 24 in this embodiment therefore axially reciprocates the bolt 42. Sliding the forearm 24 forward concomitantly causes the bolt 42 to move forward for forming a closed breech. Conversely, sliding the forearm 24 rearward causes the bolt 42 to move rearward for forming an open breech for ejecting a spent shell through a bottom ejection port 70 or chambering a fresh shell. Ejection port 70 is in communication with breech area of the lower receiver 48 to the rear of the barrel chamber 53 for receiving and ejecting the spent shell.

With continuing reference to FIGS. 1-17, an exemplary non-limiting embodiment of a magazine 80 for a shotgun is shown. The magazine 80 may have an elongated generally tubular body 82 being comprised of cylindrical walls 81, a closed front end 84, and an open rear end 85 for loading shells 60 therein or dispensing shells to the receiver 40. The body 82 includes an inner surface 86 defining an axially extending cylindrical internal cavity 87 configured and dimensioned to hold a plurality of shotgun shells in horizontally stacked end-to-end relationship. The magazine 80 may be supported by receiver 40 independently of the barrel 50 and/or forearm 24. Accordingly, magazine 80 may be supported solely by receiver 40 and in turn may support the barrel 50 and/or forearm 24 at least in part.

It bears noting that the while the inner surface 86 and cavity 87 have a cylindrical or tubular shape with a circular cross section for snugly receiving the loaded shells 60 therein, the outer surface of the body 82 may have a different cross-sectional shape other than circular or round in some embodiments.

Magazine body 82 (also referred to herein as "magazine tube") may formed of any suitable metallic (e.g. aluminum, titanium, steel, etc.) or non-metallic material (e.g. plastic, composite, etc.). In various possible embodiments, the magazine body 82 may be formed as a separate component coupled to the receiver 40, or preferably in one exemplary non-limiting embodiment may alternatively be formed as an integral unitary structural part with the receiver.

Figure 14:
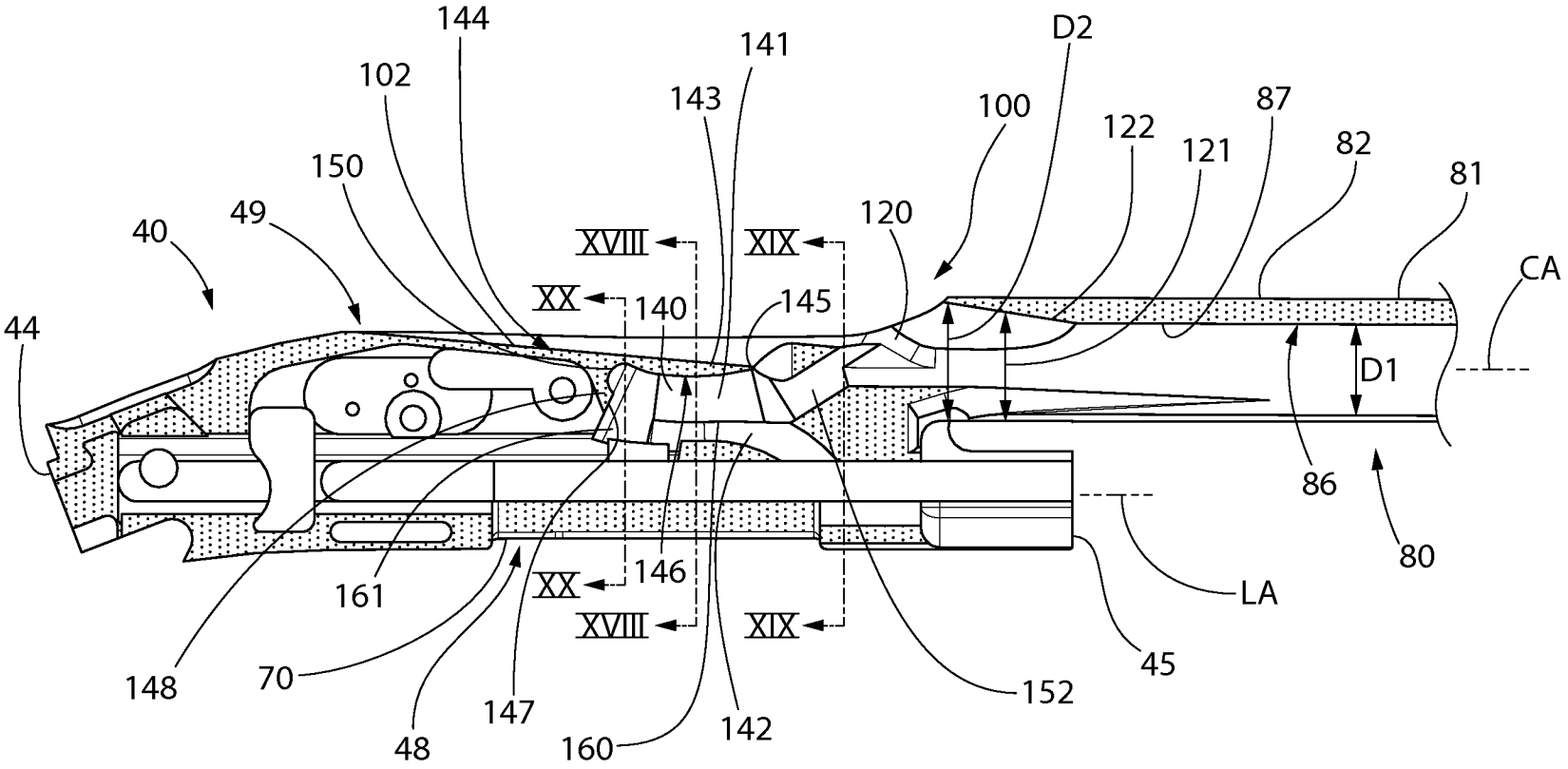
FIG. 14 is a side elevation view of a longitudinally split left half section of an integrally formed receiver-magazine assembly showing a shell guide groove system (the right half section not shown being substantially a mirror image of the left section with respect to internal geometry)
Figure 15:
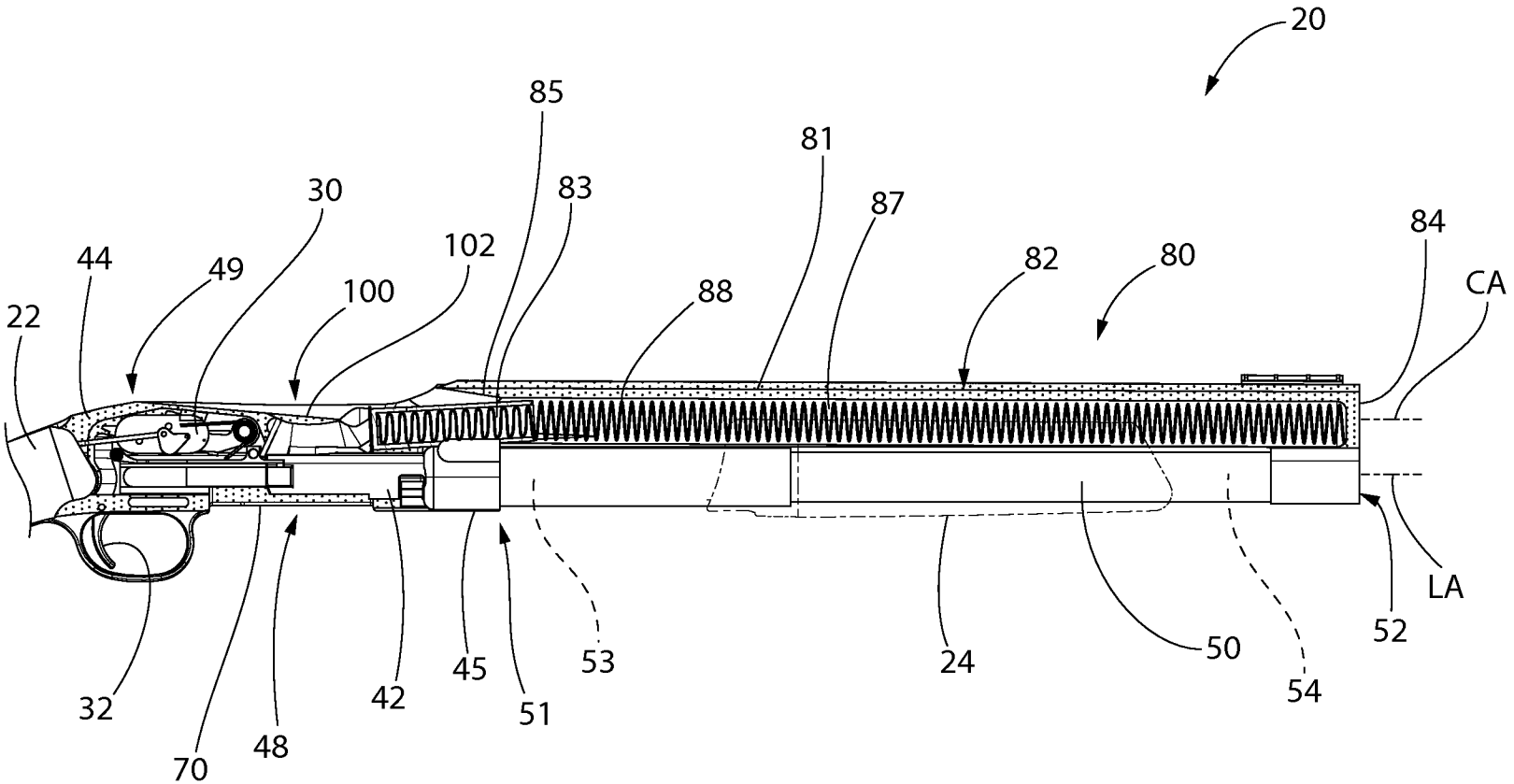
FIG. 15 is side partial cross-sectional view of the shotgun showing the complete magazine and barrel of the shotgun.
Figure 16:
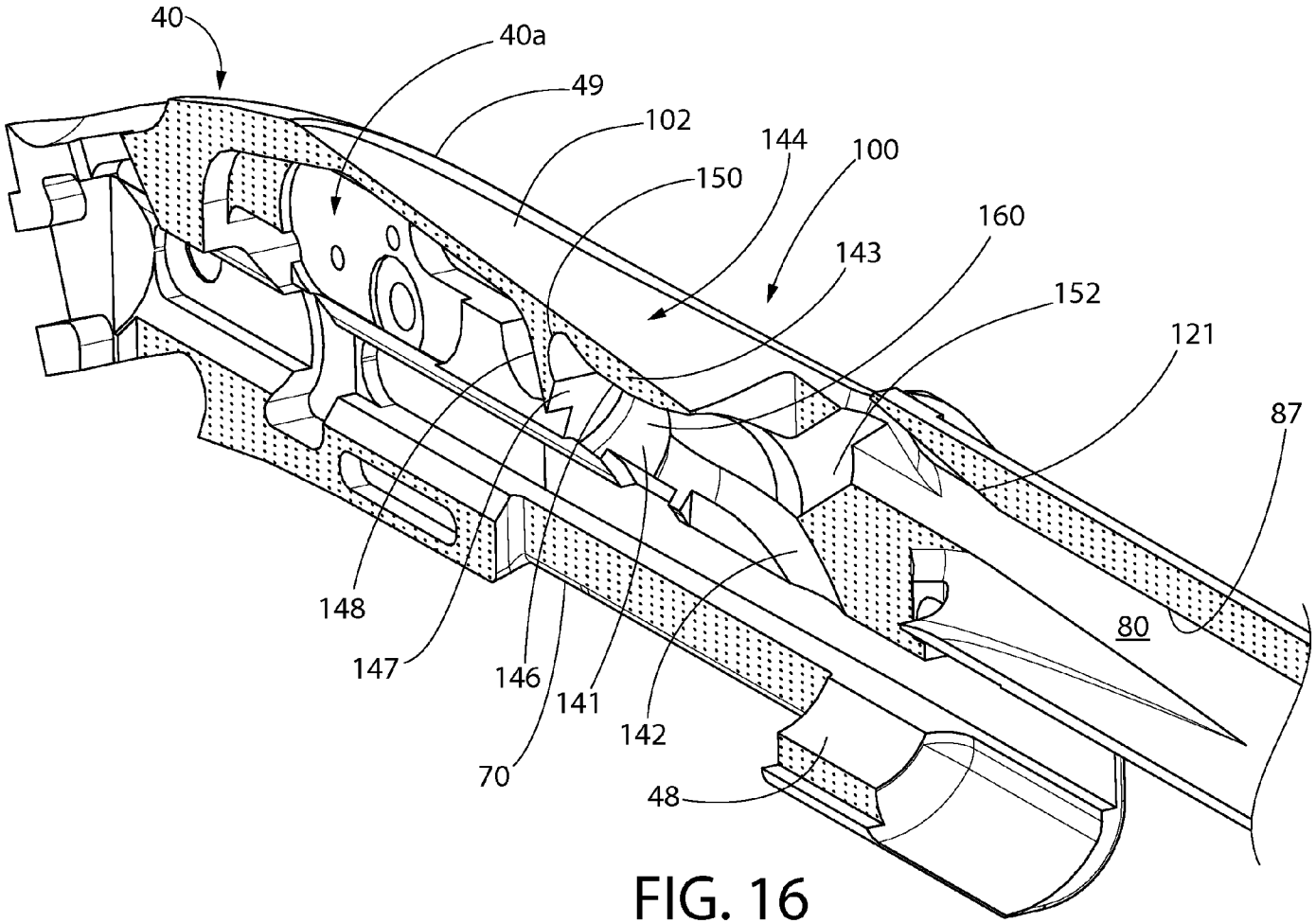
FIG. 16 is a top perspective view of the left half section of FIG. 14.
Figure 17:
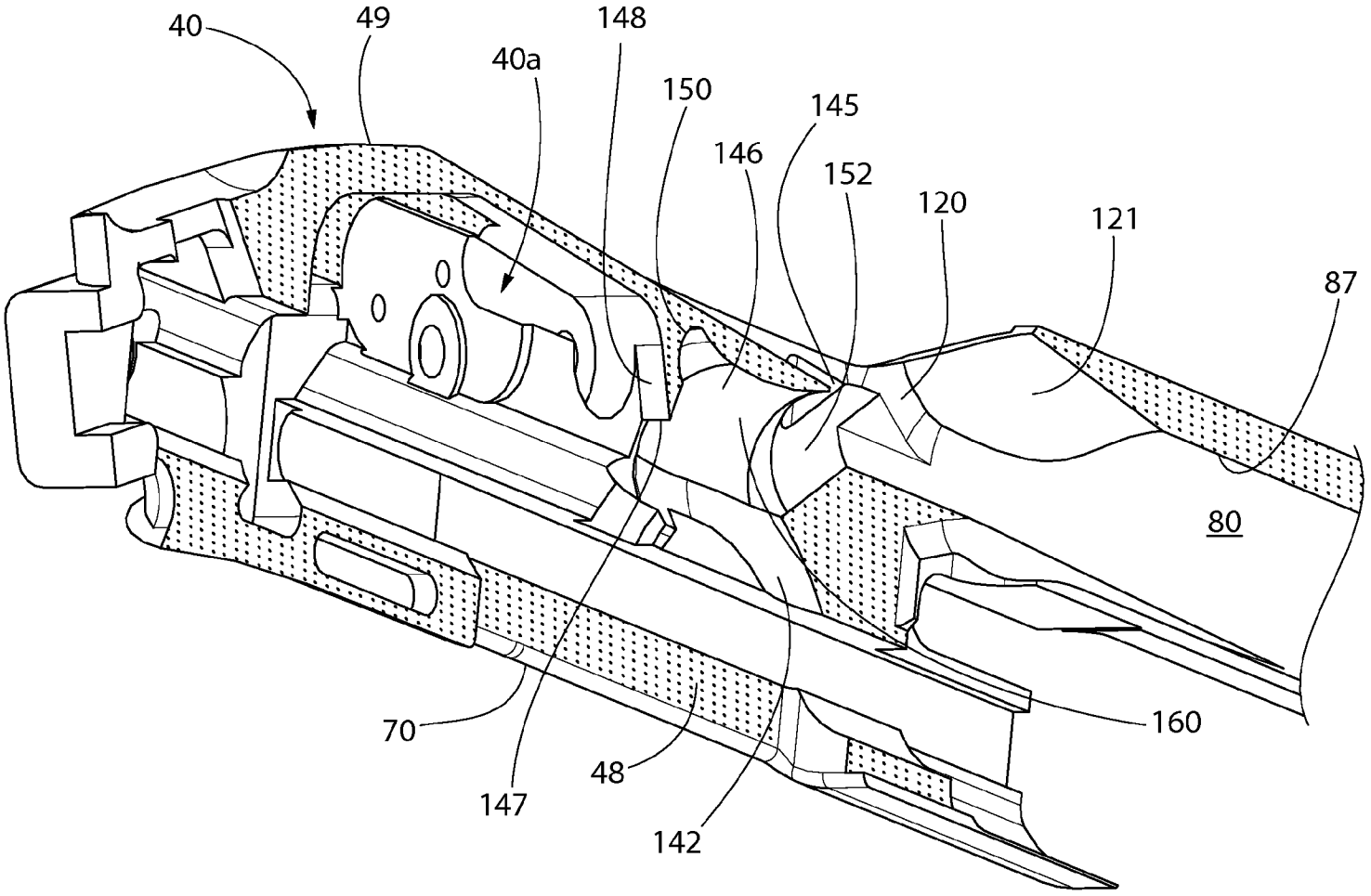
FIG. 17 is a bottom perspective view of the left half section of FIG. 14.

FIG. 14 shows the foregoing latter embodiment of receiver 40 with integrally formed magazine 80. In such a unitary structure of an integral receiver-magazine assembly 40/80, both the receiver portion and magazine portion are formed of the same metallic or non-metallic material being made simultaneously in a single process or formation step.

In one exemplary non-limiting embodiment, the integral receiver-magazine assembly 40/80 is formed of a composite thermoset material comprised essentially of carbon and glass fibers in a thermosetting epoxy resin matrix. Such a composite material forms a stiff, hard part having a greater strength and resistance to bending than aluminum for example. In one exemplary fabrication method, a composite material receiver-magazine 40/80 may formed by a compression ("press") molding process. Essentially, the composite material is placed on a heated lower mold cavity having the negative impressions of the desired features and appurtenances of the final molded part. A heated upper mold or ram is brought downward into engagement with the composite material. The heated material (with reduced viscosity) enters the impressions and details formed in the mold cavity as the upper mold comes to rest fully closing the mold. The material is held in the closed mold under pressure and heat in the mold for a set period of time until the part being formed fully cures. The mold is then opened and the part is removed. Advantageously, such a process does not require machining of the magazine or receiver portions and many contoured appurtenances including the intricate geometry of the shell guide grooves, further described herein.

In one embodiment, the integral receiver-magazine assembly 40/80 structure may be formed in two longitudinally split halves; one of which (left half) is shown in FIG. 14. This construction advantageously simplifies forming the magazine and guide grooves in the receiver, particularly when the receiver-magazine assembly 40/80 is to be molded or cast. The plurality of differently angled and contoured interior surfaces of the receiver 40 which form the shell feeding guide groove network as further described herein may be formed more readily produced without resort to more expensive machining to create such features. The split construction may be used when making the receiver-magazine assembly 40/80 from either metallic or non-metallic materials some non-limiting examples of which are described above.

Figure 21:
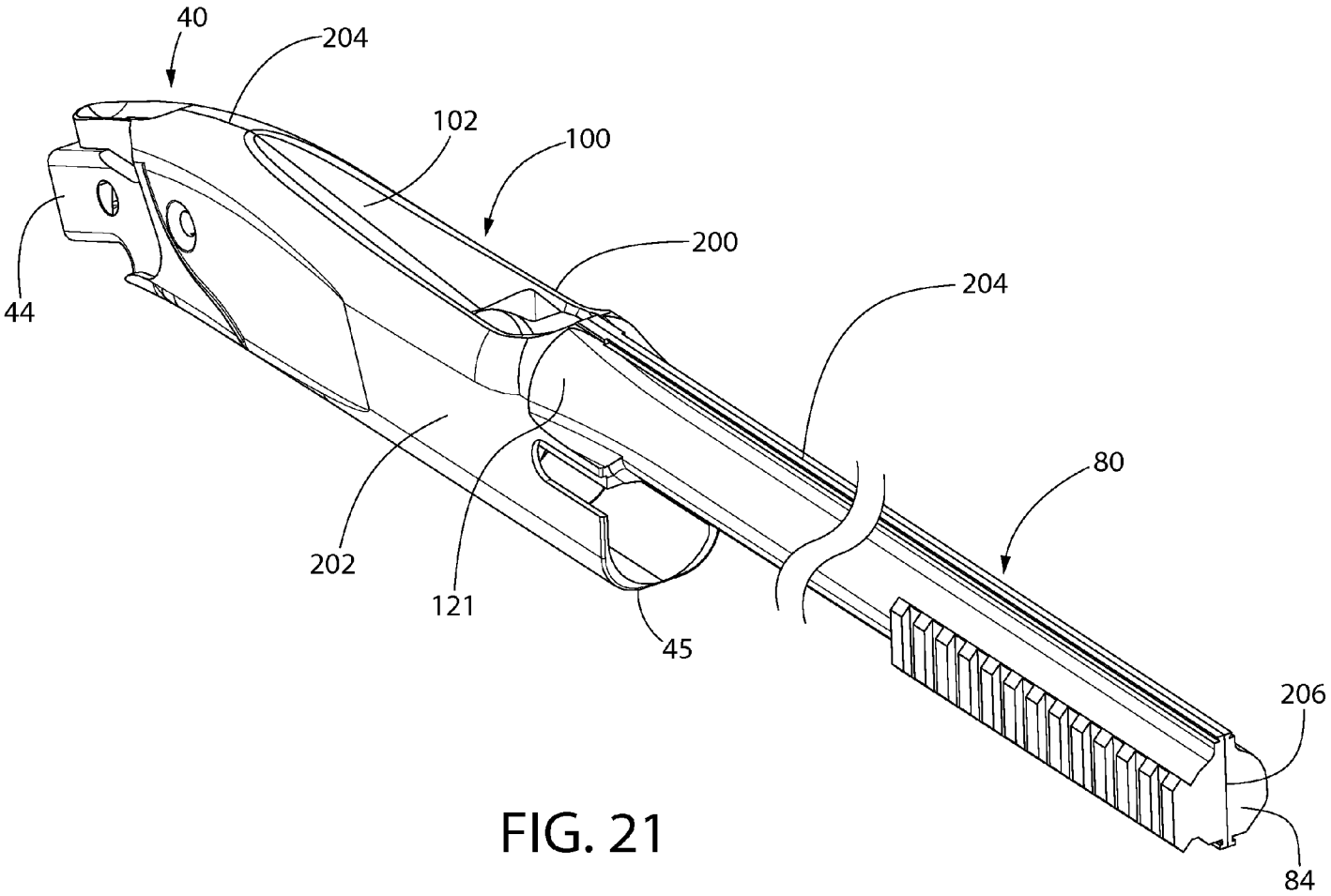
FIG. 21 is a top perspective view of the right and left half sections of the receiver-magazine assembly in an assembled condition.

FIG. 21 shows an assembled longitudinally split receiver-magazine assembly 40/80 formed of two halves similar to that shown in FIG. 14. Such a construction includes left and right half sections 200, 202 forming longitudinal seams 204 from front to rear and vertical and/or angled seams 206 from top to bottom when connected together. After forming, each of the receiver-magazine left and right half sections 200, 202 may be assembled and coupled together by any suitable method (e.g. pins, fasteners, interlocks, welding, soldering, etc.) to form a complete receiver-magazine 40/80 assembly. It should be noted that in each of the half sections 200, 202, the magazine 80 portion is formed as an integral unitary structural part with the receiver 40 portion producing two monolithic half sections.

A follower 83 and magazine spring 88 assembly is disposed inside the magazine tube. The spring 88 biases the follower 88 rearward for feeding the stack of shells 60 into the receiver 40. In one embodiment, spring 88 may be a compression spring; however, other suitable type springs may be used to bias the stack of shells. Spring 88 has a front end abutting the closed front end 84 of the magazine body 82 and rear end engaging the follower 83. In one embodiment, follower 83 may have a hollow tubular body comprised of an open front end 89, a closed rear end 91, and cylindrical sidewalls 90 extending therebetween. Follower 83 defines an internal cavity 92 configured to receive the rear portion of spring 88 therein. The rear end of spring 88 engages the closed rear end 91 of follower 83. Positioning a portion of the spring 88 into a majority of the length of the internal cavity 92 helps limit the downward rotation of follower 83 when the rear end partially enters the shell guide grooves to maintain contact with the shell (see, e.g. FIG. 10). The spring 88 and spring force make it more difficult for the follower to rotate out of the horizontal position, thereby keeping the front end of the follower engages in the magazine tube.

Shotgun type shells 60 are generally comprised of metal shot and gunpowder packed inside a hollow cylindrical non-metal hull or case 61 secured to a metal head (base) 62. The case 61 typically has a crimped closed front end and contains shot. Shot is generally comprised of a plurality of round metal pellets (e.g. lead or steel) which are offered in various diameters typically dictated by the type of activity (e.g. clay target shooting or game hunting) and size of the game, among other factors. Other types of shot, however, including single elongated bullets or other single or multiple shaped projectiles may be packed inside the case.

The head 62 of the shell or cartridge includes a protruding peripheral flange or rim 64 that projects radially outwards beyond the head and contains a primer which is struck by the firing pin and detonated to ignite the gunpowder charge for firing the shotgun. The rim 64 therefore has a larger diameter than the diameter of the shell head 61, which in turn has a larger diameter than the case 61. Accordingly, rim 64 is diametrically larger than the case or head.

In one embodiment with reference to FIG. 1, follower 83 has a configuration similar to a shell 60 to act as a surrogate for a shell in guiding the shell at least initially into lower guide groove 140 and towards the lower receiver 40 for chambering. Accordingly, follower 83 may include a diametrically enlarged rim 95, adjoining head portion 93, and case portion 94 similar to the shell. The rim 95 therefore has a larger diameter than the diameter of the head portion 93, which in turn has a larger diameter than the case portion 94. Accordingly, rim 95 is diametrically larger than the case portion or head portion.

In one embodiment, follower 83 has a larger axial length than a shell 60. This prevents the rear end of follower 83 from being able to tilt downward enough for the follower to fully enter the lower guide groove 140 like the shells 60, thereby retaining the follower in the magazine 80 tube. The extended length engages the top surface of cylindrical follower sidewall 90 with the top inner surface of cavity 87 in the magazine 80 to limit rotation or tilt of the follower (see, e.g. FIGS. 1 and 10). Advantageously, when the last shell 60 has been loaded, the follower 83 is positioned for loading new shells into magazine 80 as shown in FIG. 1.

In order to feed and chamber a shell 60 dispensed by the tubular magazine 80, a shell feed system is provided that advantageously eliminates the need for a shell elevator or carrier as found in top barrel mounted shotguns to chamber a round. Advantageously, the shell feed system functions by gravity and a unique geometry formed by specially contoured and dimensioned internal surfaces of the receiver 40 to establish the shell feed pathways from the magazine 80 to barrel 50 for feeding and chambering a round, as further described herein.

Referring to FIGS. 1-20, the shell feed system in one embodiment includes a top loading port 100 including an inclined loading ramp 102, an upper guide groove 120, and a lower guide groove 140. Loading ramp 102 may have any suitable shape, including flat or curved in transverse cross section. Upper guide groove 120 is in communication with and forms an upper shell pathway between the loading port 100 and magazine 80 for loading shells 60 into the magazine. Lower guide groove 120 is in communication with upper guide groove 120 and forms a lower shell pathway between the magazine 80 and chamber 53 of barrel 50. The upper and lower guide grooves 120, 140 are disposed primarily in the upper receiver 49 defined herein as the portion of the receiver 40 disposed above the bolt 42. The upper and lower guide grooves 120, 140 are formed and defined by specially contoured and dimensioned internal surfaces inside the receiver 40.

The upper and lower guide grooves 120, 140 have a geometry configured and dimensioned to receive and guide the ammunition shell 60 through the receiver 40 to the magazine 80 and ultimately the barrel chamber 53. Accordingly, the guide grooves 120, 140 have portions specifically conforming to the size and cross-sectional geometry (transverse) of the shells 60. In one embodiment, the lower guide groove 140 includes portions having a cross-sectional geometry designed to conform with and engage the rear rim 64 of the shell for guiding the travel of the shell through the guide groove. Such portions may be sized slightly larger in width than the rim 64 for such a purpose.

In one embodiment, the magazine 80 includes an outwardly flared bell mouth-shaped entrance 121 formed at the rear end 85 of the magazine 80 (see, e.g. FIG. 14). This forms a smooth transition into the main tubular portion of the magazine to facilitate loading shells 60 via the upper guide groove 120 from loading port 100 into magazine 80. Entrance 121 includes inclined surfaces 122 is formed and starting proximately forward of the front edge 101 of loading port 100 forming the bell mouth shape. The inclined surfaces 122 slope upwardly going front to rear in the barrel entrance 121 and narrows the entrance moving towards the front to essentially the inside diameter D1 of the main portion of magazine 80 tube where the cylinder walls 81 are substantially parallel to each other. The inclined surfaces 122 allows shells 60 to be loaded into and manually removed from magazine 80 at an oblique angle (to the horizontal centerline axis CA of the magazine) to simplify the manual shell loading or removal process as further described herein. The inclined loading ramp 102 cooperates with the magazine entrance 121 to deliver the shells at a proper angle from loading into the magazine 80. Due to the bell mouth magazine entrance 121, the rear end 85 of magazine 80 therefore has a diameter D2 which is larger than the diameter D1 of the Referring to FIGS. 1-20, lower guide groove 140 communicates with the upper guide groove 120 and is configured to move the shells 60 dispensed by the magazine 80 rearward and then drop the shells downward for forward loading into the barrel chamber 53 by the bolt 42 when closing the action and breech. To enable such shell movement, lower guide groove 140 includes an upper portion 141 in which the shell 60 travels downward and rearward from the magazine 80, and a lower portion 142 in which the shell travels downward and forward from the upper portion 141 into the lower receiver 48 for chambering. The lower portion 142 defines an exit portion of the lower guide groove 140.

Upper portion 141 of lower guide groove 140 includes an entrance portion 152 and a central portion 160 disposed rearward of the entrance portion. Entrance portion 152 is downwardly and rearwardly angled or inclined and slopes downward from front to rear. The entrance portion 152 is configured and dimensioned to receive a shell 60 from upper guide groove 120 for chambering.

Conversely, the lower or exit portion 142 of the lower guide groove 140 is downwardly and forwardly angled or inclined and slopes downward from rear to front. Both the entrance and exit portions may be obliquely angled with respect to the longitudinal axis. The central portion 160 communicates with both the entrance and exit portions 152, 142. The upper and lower portions 141, 142 roughly approximate a rotated Y-shaped shell pathway between the front and rear of the receiver 40.

The upper portion 141 of lower guide groove 140 is configured and dimensioned to prevent a shell 60 dispensed rearward by magazine 80 from moving back upwards into the loading port 100. To facilitate this shell motion, a generally wedge-shaped horizontal shell division wall 143 is formed in the upper portion 141 which horizontally separates the rear section of the lower guide groove 140 (i.e. upper portion 141) from the loading port 100. Division wall 143 includes a linear or slightly rounded narrow front tip or edge 145 and an arcuately-shaped convex bottom surface 146 in the axial direction from front to rear (e.g. when viewed from a lateral direction as in FIGS. 1, 2, 7, 9, and 10). In transverse cross section, bottom surface 146 may also be arcuately shaped and may continue circumferentially downward forming opposing arcuate lateral sidewalls 149 of the upper portion 141 of lower guide groove 140. In one non-limiting configuration, the contiguous bottom surface 146 and sidewalls 149 may extend circumferentially through an angle of at least 180 degrees. Other circumferential extents are possible. Front edge 145 of division wall 143 may be arcuately shaped in the transverse direction from right to left when as viewed in an axial direction. In one embodiment, a top surface 144 of the division wall 143 may form the forward-most section of the loading ramp 102 and front edge 145 of wall 143 forms the front terminal end of the ramp 102 (spaced horizontal apart from front edge 101 of loading port 100.

The central portion 160 of lower guide groove 140 may have an arcuate shape in the longitudinal direction. The bottom surface 146 of horizontal division wall 143 forms the arcuately shaped top of the central portion 160. As further described herein, the arcuate shape of the central portion 160 functions to rotate the head 62 of shell 60 upwards and reposition the angular orientation of the shell for feeding into the exit portion 152 towards the lower receiver 48 and barrel 50 for chambering the round.

Also disposed in the rearmost part 161 of the central portion 160 of lower guide groove 140 is a rear stop protrusion 148. Protrusion 148 extends downwardly and forwardly from the receiver 40 (e.g. loading ramp 102) into the lower guide groove 140, thereby forming a cantilevered arm positioned to engage the head 62 of a shell 60 dispensed from the magazine 80. Stop protrusion 148 defines a rear abutment surface 147 that directly contacts the head 62 of shell 60 to stop the shells rearward travel. Abutment surface 147 is spaced vertically below and apart from bottom surface 146 of division wall 143 and forms a rear wall of the upper portion 141 of lower guide groove 140.

Figure 9:
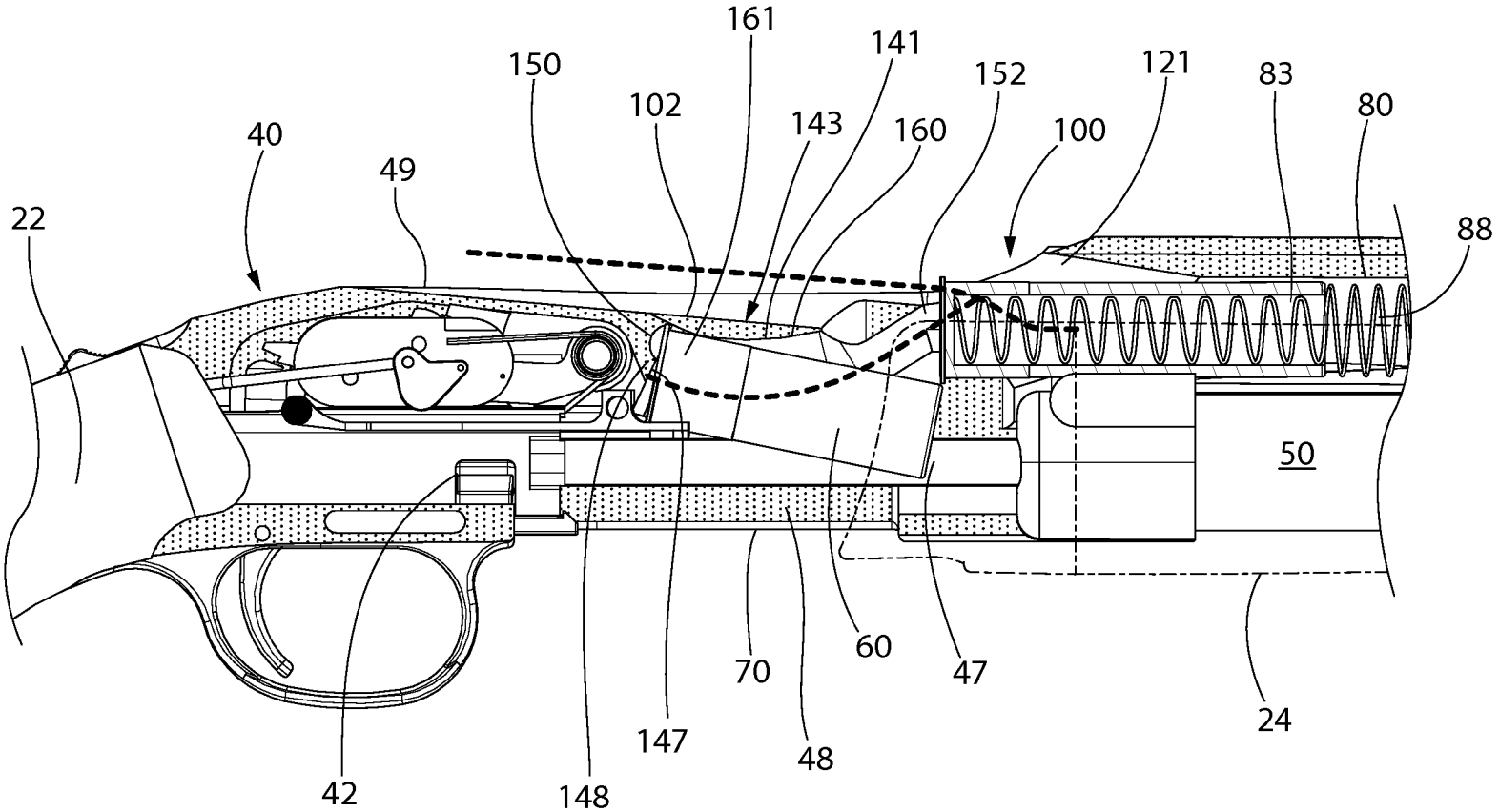
Figure 10:
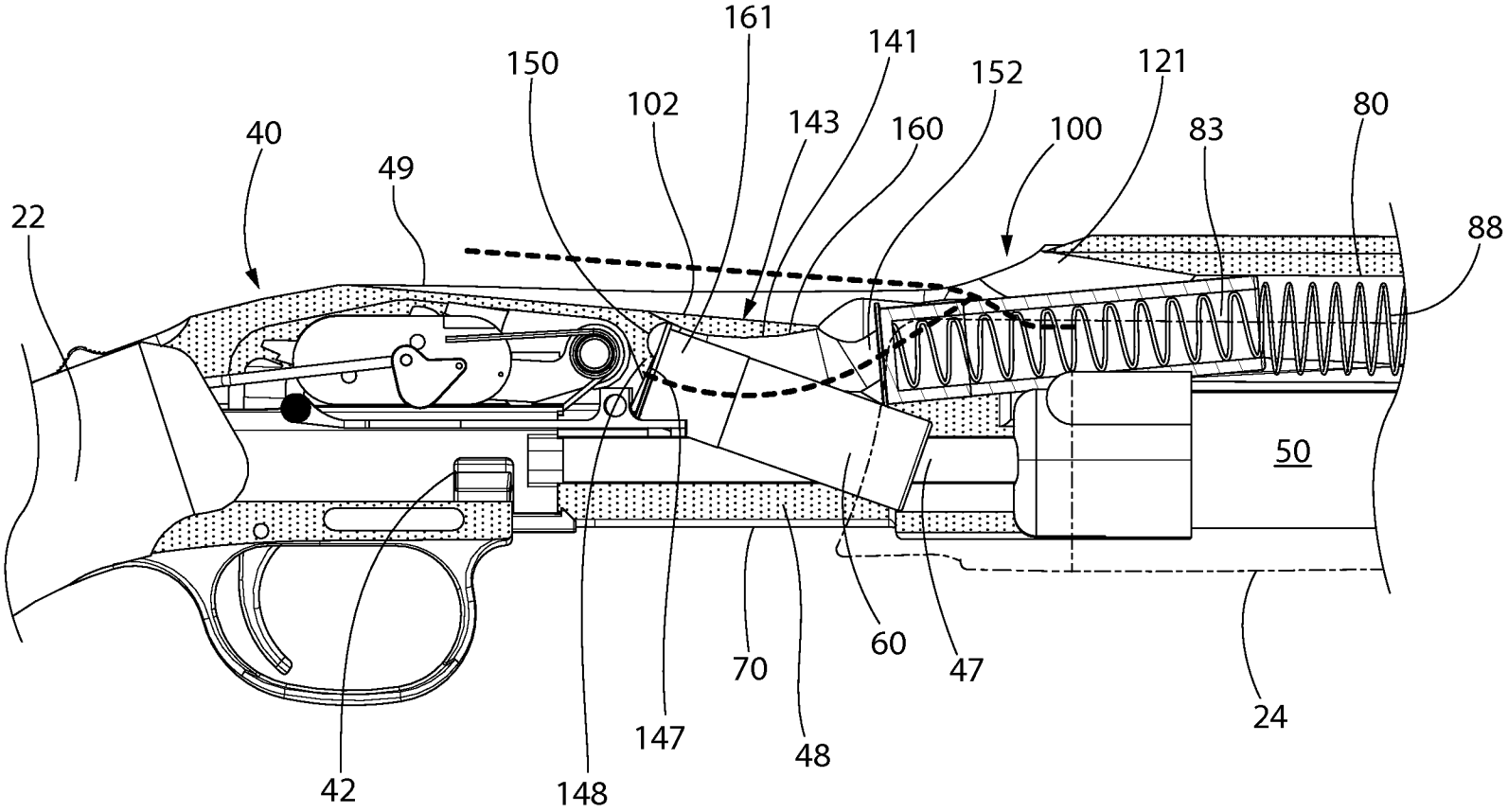
Figure 11:
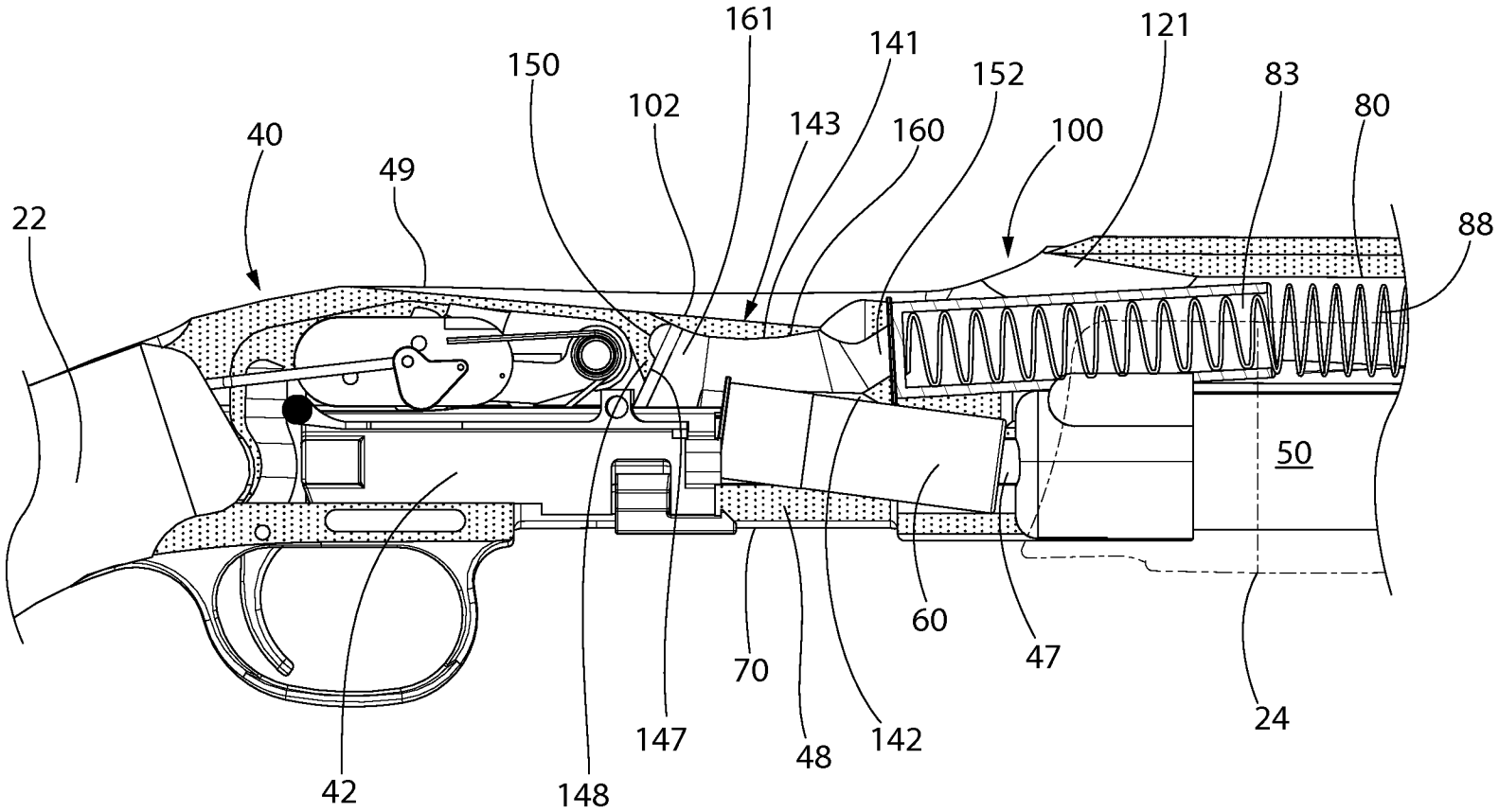
Figure 12:
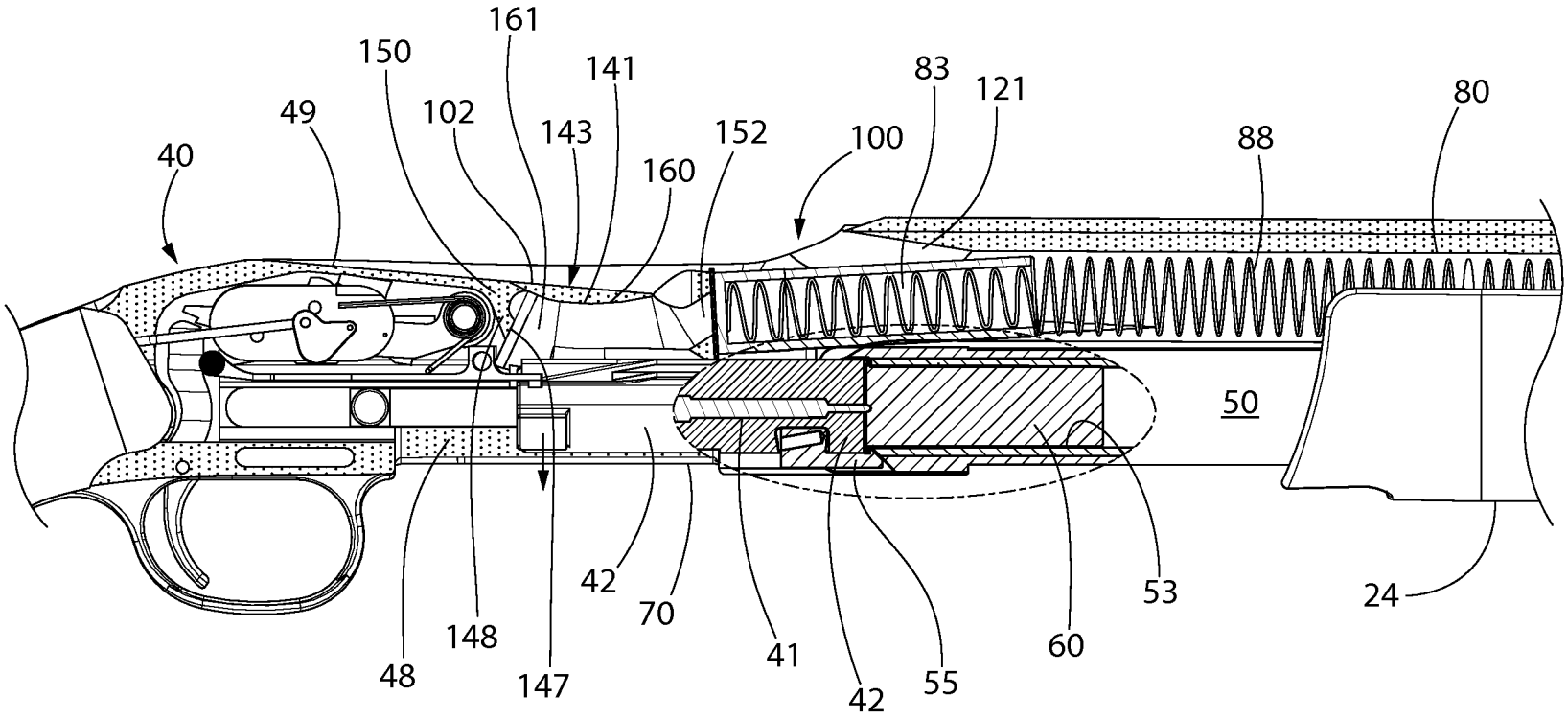

In one arrangement, abutment surface 147 may be obliquely angled with respect to longitudinal axis LA of shotgun 20 in a forward and downward facing direction to reposition the head 62 of the shell 60 and cause the front end of the shell case 61 to drop downwardly into the lower or portion 142 of lower guide groove 140 (see, e.g. FIGS. 9-10). This better angles the shell for chambering into barrel 50 when bolt 42 is moved forward to close the action or breech. A recess 150 may be formed above abutment surface 147 between bottom surface 146 of division wall 143 and stop protrusion 148 to provide clearance for rotation of the shell head 62 and rim 64.

Figure 18:
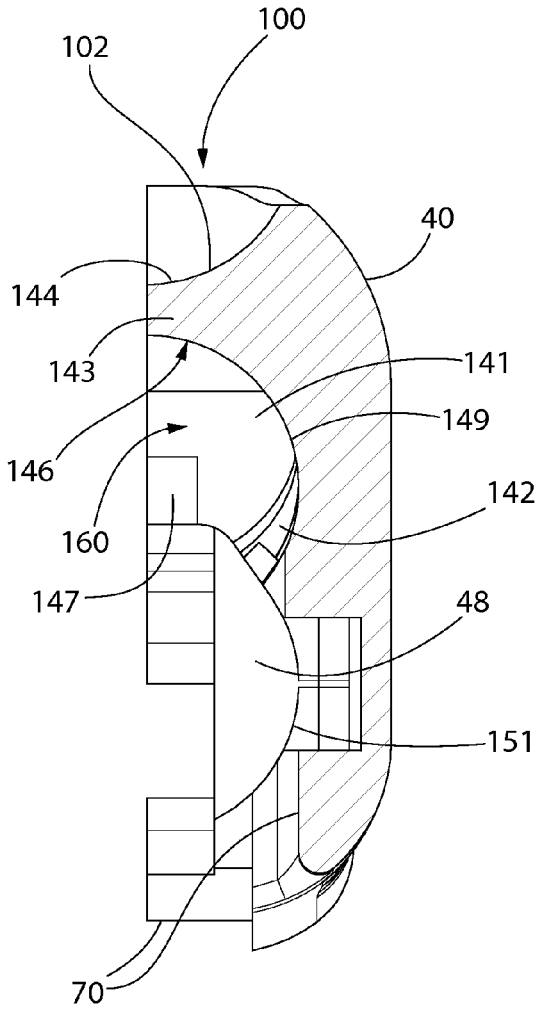
FIG. 18 is a transverse cross-sectional view of the left half section of FIG. 14 taken along line XVIII.
Figure 19:
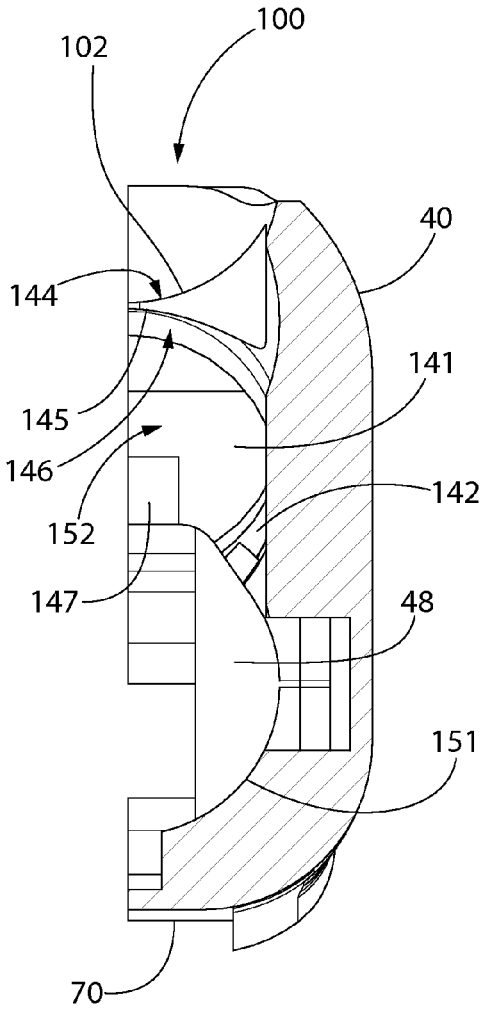
FIG. 19 is a transverse cross-sectional view of the left half section of FIG. 14 taken along line XIX.
Figure 20:
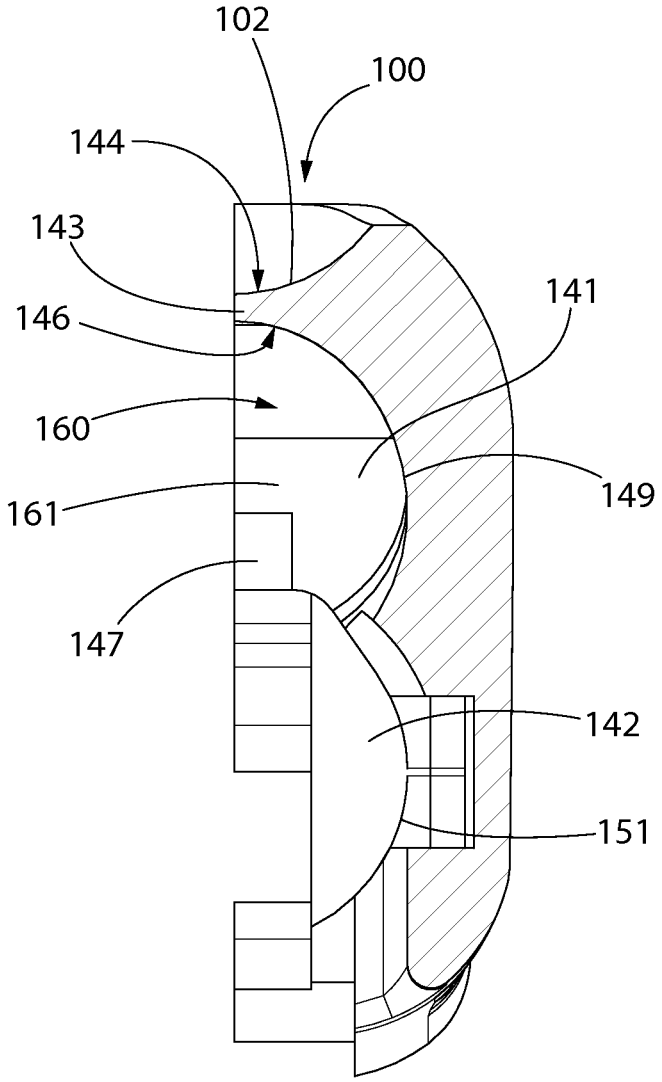
FIG. 20 is a transverse cross-sectional view of the left half section of FIG. 14 taken along line XX.

The lower receiver 48 primarily defining the breech area between bolt 42 and Barrel chamber 53 may include portions having arcuately shaped sidewalls 151 to help positively align and feed shells 60 forward in an axial direction into chamber 53 of barrel 50 (see, e.g. FIGS. 18-20).

Operation of the shell feeding system will now be described. FIGS. 1-13 show sequential side views of shotgun 20 during the process of loading the magazine and feeding shells from the magazine through the receiver to the barrel. The action or breech of the shotgun initially starts in an open position. The shell pathway into the magazine and through the receiver shell guide grooves are shown in dashed lines.

Referring to FIG. 1, a shell 60 is slid forward along the loading ramp 102 in the loading port 100 towards the magazine 80. Follower 83 is automatically retained in the position shown when the magazine is empty. This positions an exposed top portion of the rear wall 91 and rim of the follower partially above loading ramp. The front end of the shell case 61 engages follower 83 pushing it forward along with the shell through the upper guide groove 120 and progressively farther into the magazine cavity 87. This action compresses spring 88. The head 62 (with rim 64) of the shell 60 defines a leading end and the case 61 defines a trailing end during the initial shell feeding movement.

Figure 2:
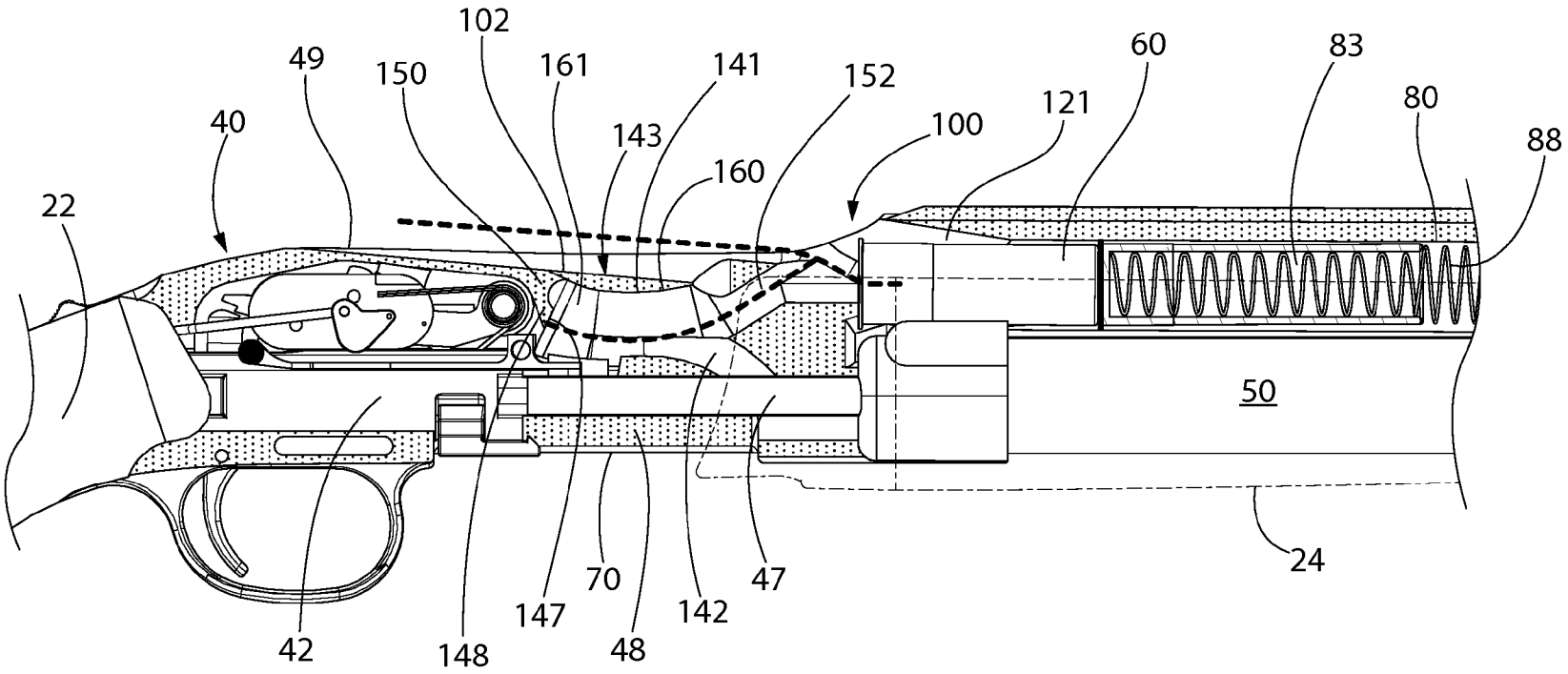

FIG. 2 shows the shell 60 now inserted and horizontally positioned in the magazine 80. The shell would be temporarily held in this position shown by the user (e.g. thumb and/or fingers) still apply pressure to the head 62 of the shell. The shell is now positioned for chambering.

Figure 3:
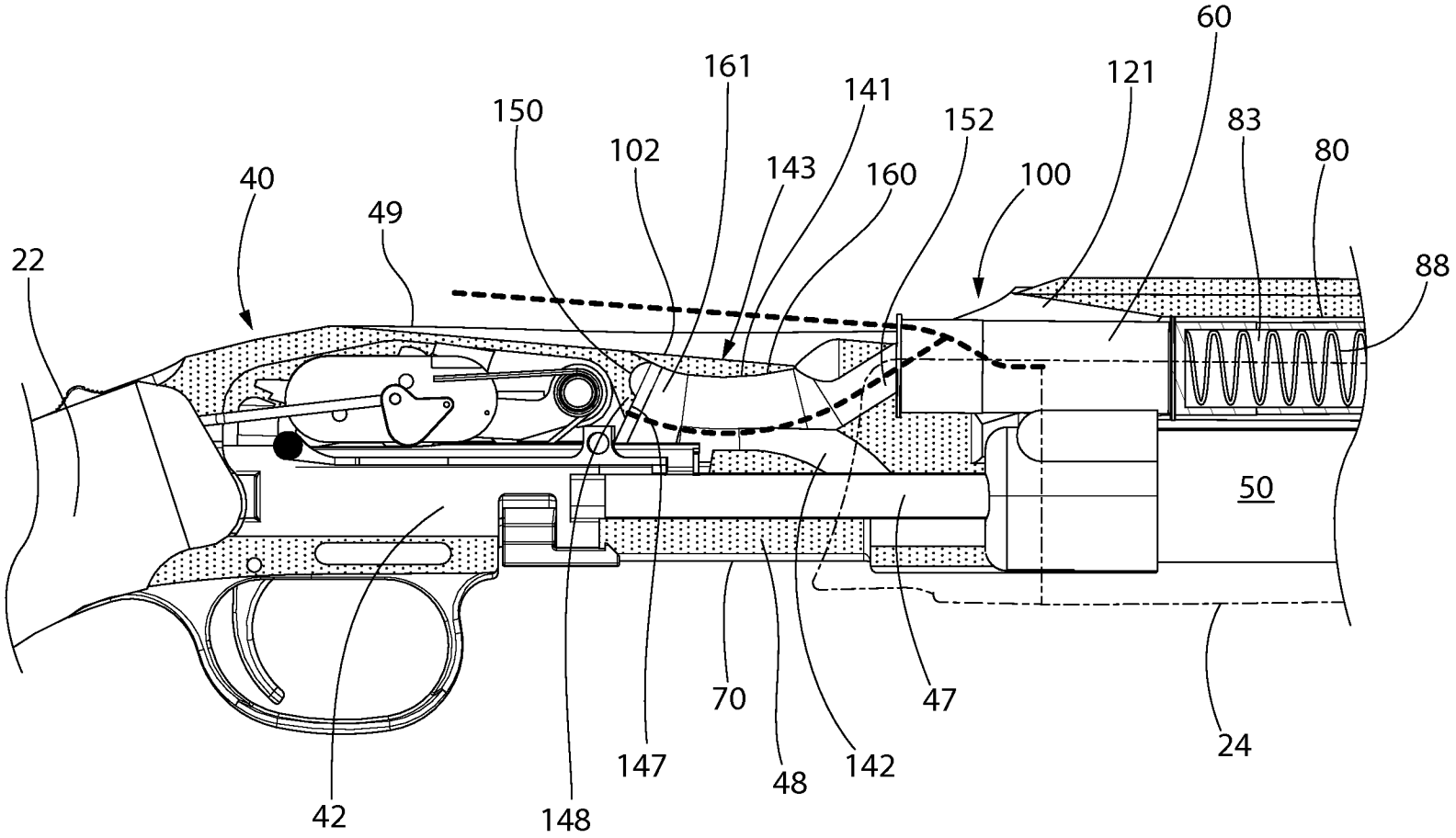

FIG. 3 shows the shell 60 starting to move rearward into the receiver 40 after the shell has been released by the user. Spring 88 begins to expand moving the follower 83 rearward. The follower 83 in turn drives the shell 60 rearward so that the rim 64 of the shell makes initial contact with the top of downward angled ramp surfaces formed by the entrance portion 152 of lower guide groove 140.

Figure 4:
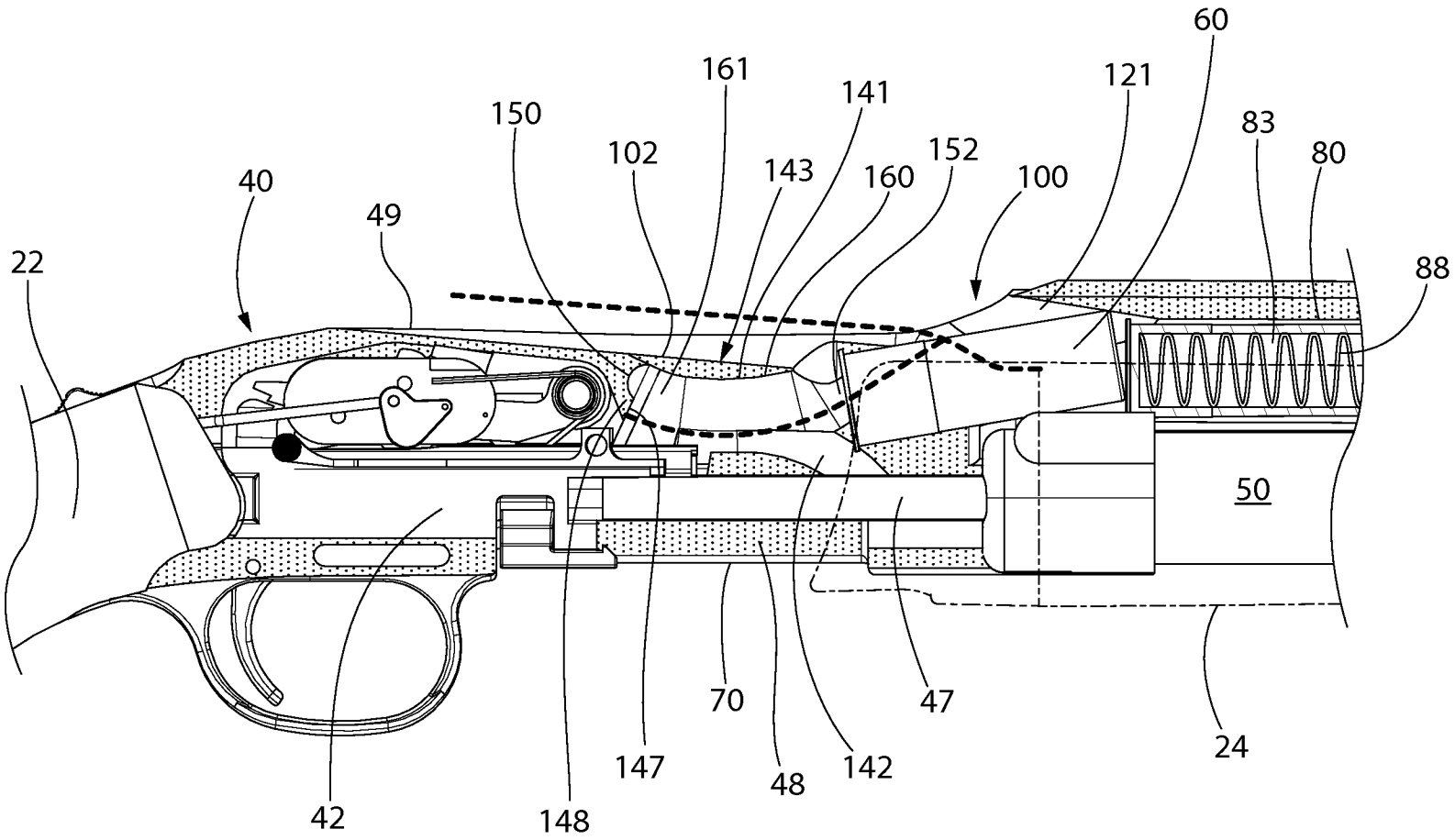

As the shell 60 progresses rearward, the ramp surfaces of the entrance portion 152 of lower guide groove 140 slidingly engage the shell rim 64 to tilt or rotate the head 62 of the shell angularly downwards in a first rotational direction as shown in FIG. 4. The shell has begun to rotate into a first angled position in which the head 62 (leading end) is lower than the opposite free end of the case 61 (trailing end). The top of the shell case 61 (at the front) and bottom of the shell case slidingly contact and are contained by the bell-mouthed magazine tube entrance 122.

Figure 5:
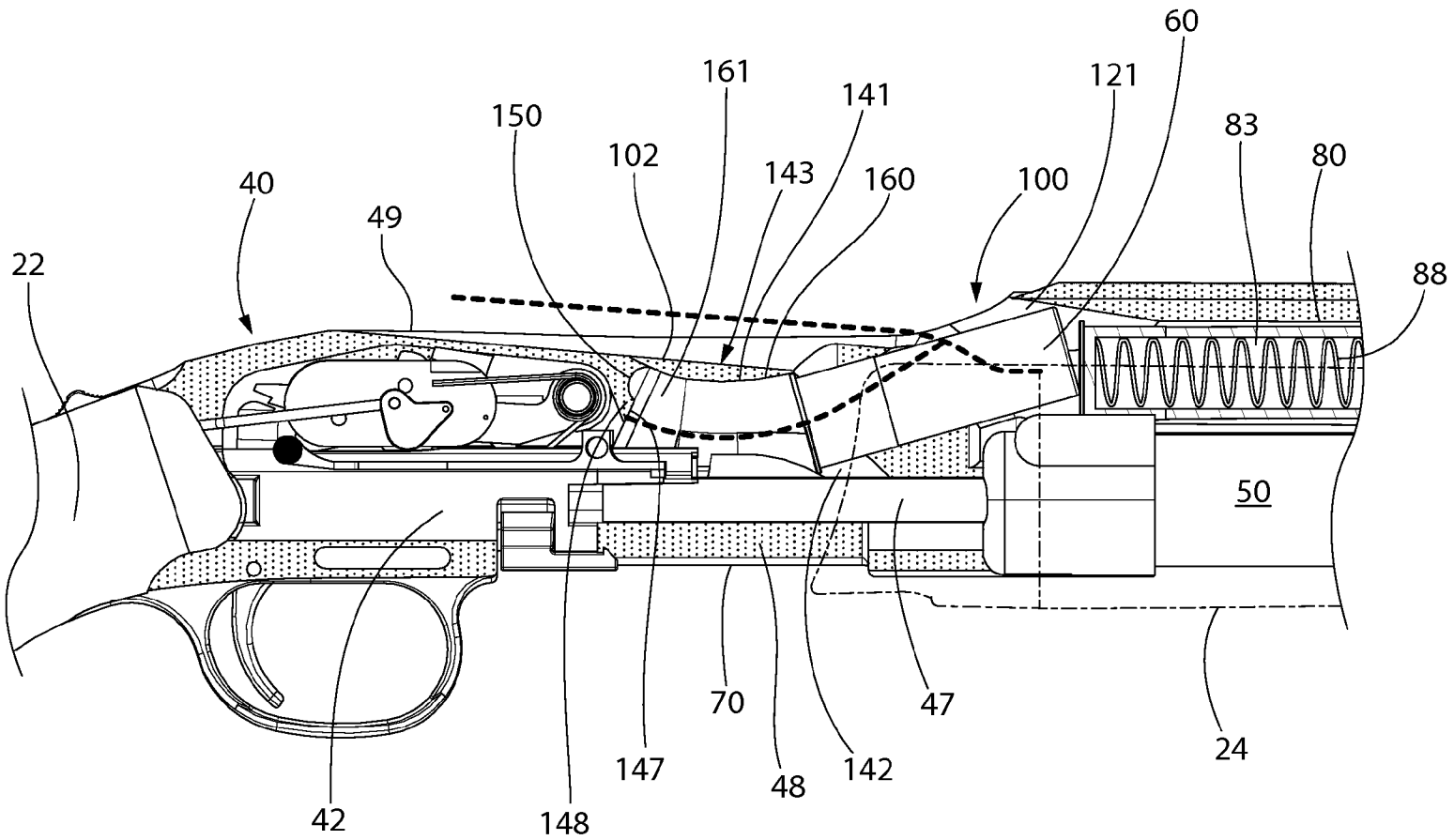
Figure 6:
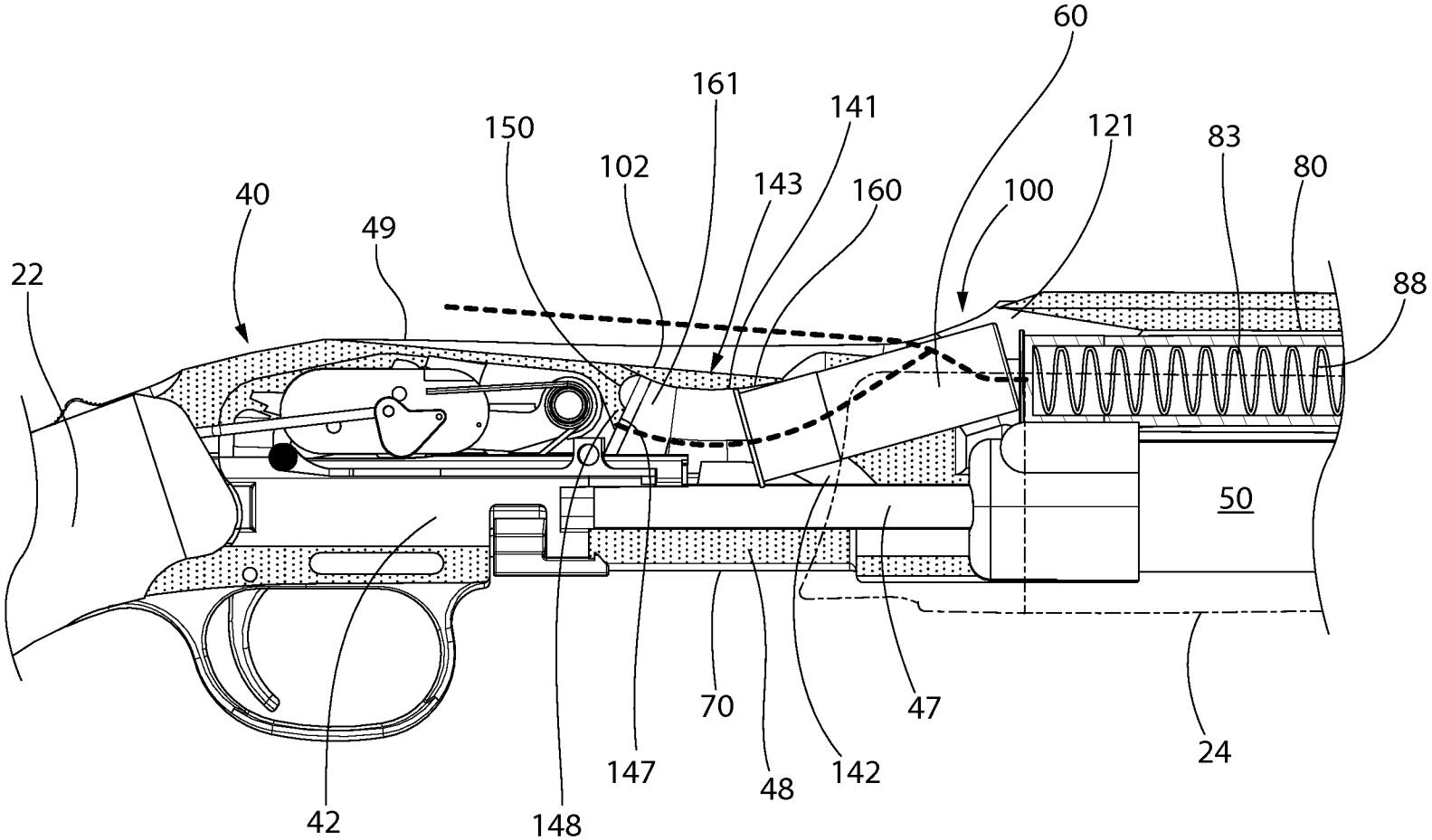

In FIG. 5, the shell 60 is shown in the fully rotated first rotational position and still positioned in the entrance portion 152 of the guide grooves. As shown, the shell 64 rim now reaches the bottom of the ramp surfaces in the angled entrance portion 152 and enters the central portion 160 of the lower guide groove 140. The top of the rim 64 slides beneath the front edge 145 of the divisional wall 143. The shell 60 continues to travel rearward with the rim 64 making sliding contact with convexly curved bottom surface 146 of division wall 143 (see, e.g. FIG. 6). The front of the shell case 61 has now broken engagement with the magazine tube.

Figure 7:
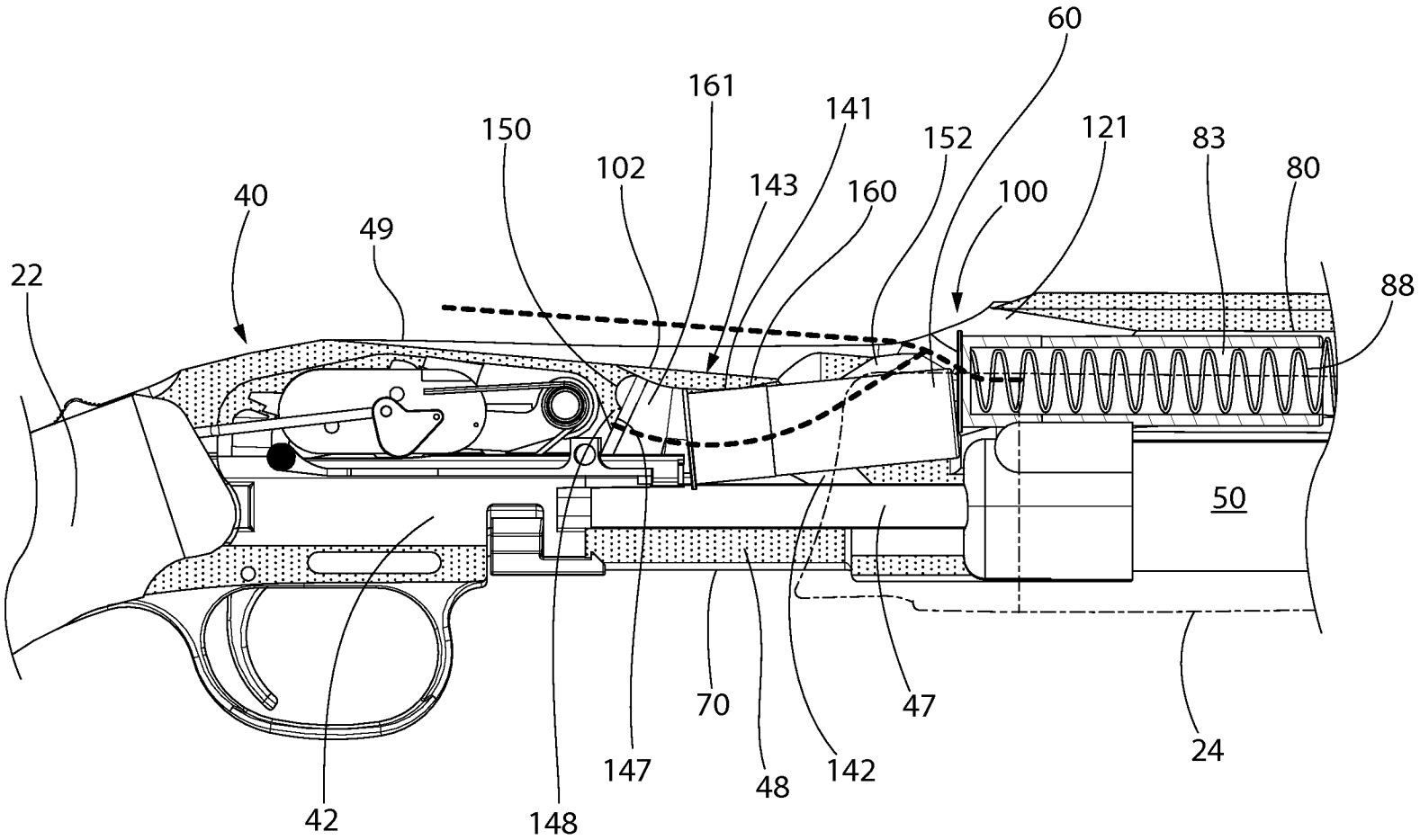
Figure 8:
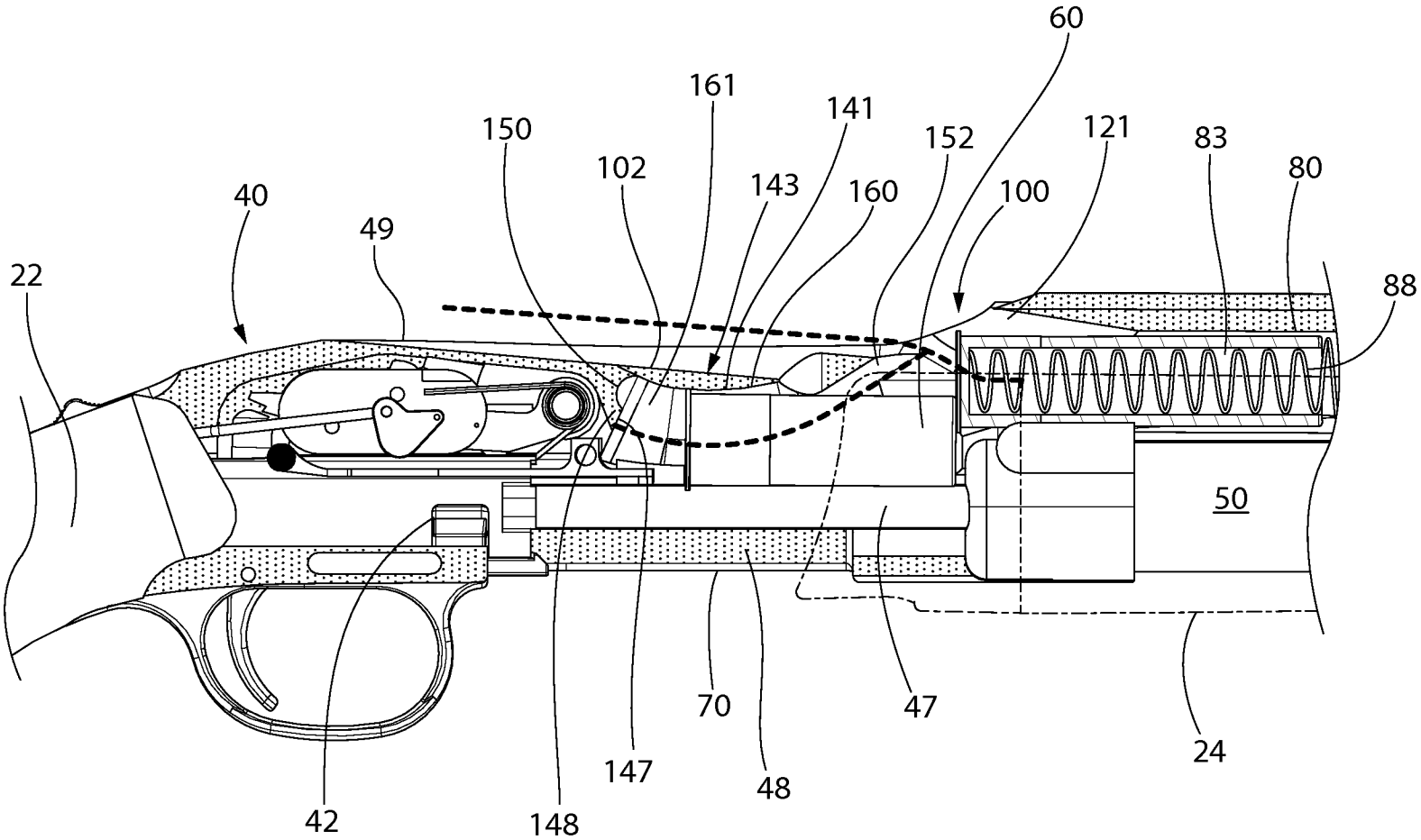

As shell 60 travels rearward farther in central portion 160 of the lower guide groove 140, the arcuate shape of the central portion begins to rotate the head 62 of the shell upwards in a second rotational direction as the shell rim 64 slides along the bottom surface 146 of division wall 143. This in turn rotates the forward shell case 61 downwards as shown in FIG. 7. Eventually, the shell 60 rotates back into a horizontal position within the central portion 160 of the lower guide groove 140 shown in FIG. 8. The head 62 and case 61 of shell 60 lie in the same horizontal plane again. The follower 83 still bears against and abuttingly contacts the front of the shell case 61.

Referring to FIG. 9, shell 60 continues to both travel further rearward in receiver 40 and rotate more in the second rotational direction as the shell rim 64 is slidingly guided along the arcuately shaped shell path formed by the central portion 160 of the guide groove. This shell movement continues until the head 62 of the shell 60 strikes and contacts the abutment surface 147 formed in the rearmost part 161 of the central portion 160 in the lower guide groove 140. The shell 60 now assumes an angular orientation again and fully reaches a second angled position in which the head 62 (leading end) is higher than the opposite free end of the case 61 (trailing end). This angular positioning moves the front end of the shell case 61 into the lower receiver 48 (i.e. receiver portion below the top of the bolt 42). Note that the front or tip of the shell case 61 now is forced down and drops below the rear wall 91 of the follower 83.

Referring to FIG. 10, the follower 83 slidingly engages and rides over the top of the shell case 61. The shell rotates and is forced down further until the tip or front of the shell rests on the bottom of the receiver 40 proximately forward of the ejection port 70. In this position, the bolt 42 can then be moved forward to engage the head 62 of the shell 60 for chambering. Next, the user slides the forearm 24 forward to close the breech. The bolt moves forward and engages the shell, which is pushed axially towards the barrel 50 (see, e.g. FIG. 11). Note that the follower 83 (or the second last shell if one remains) continues to apply downward pressure or force on the shell case 61 to ensure that the shell does not pop back upwards. The shell eventually becomes fully inserted into the barrel chamber 53 placing the shotgun 20 in the ready-to-fire condition shown in FIG. 12. The breech or action is now fully closed and locked.

Figure 13:
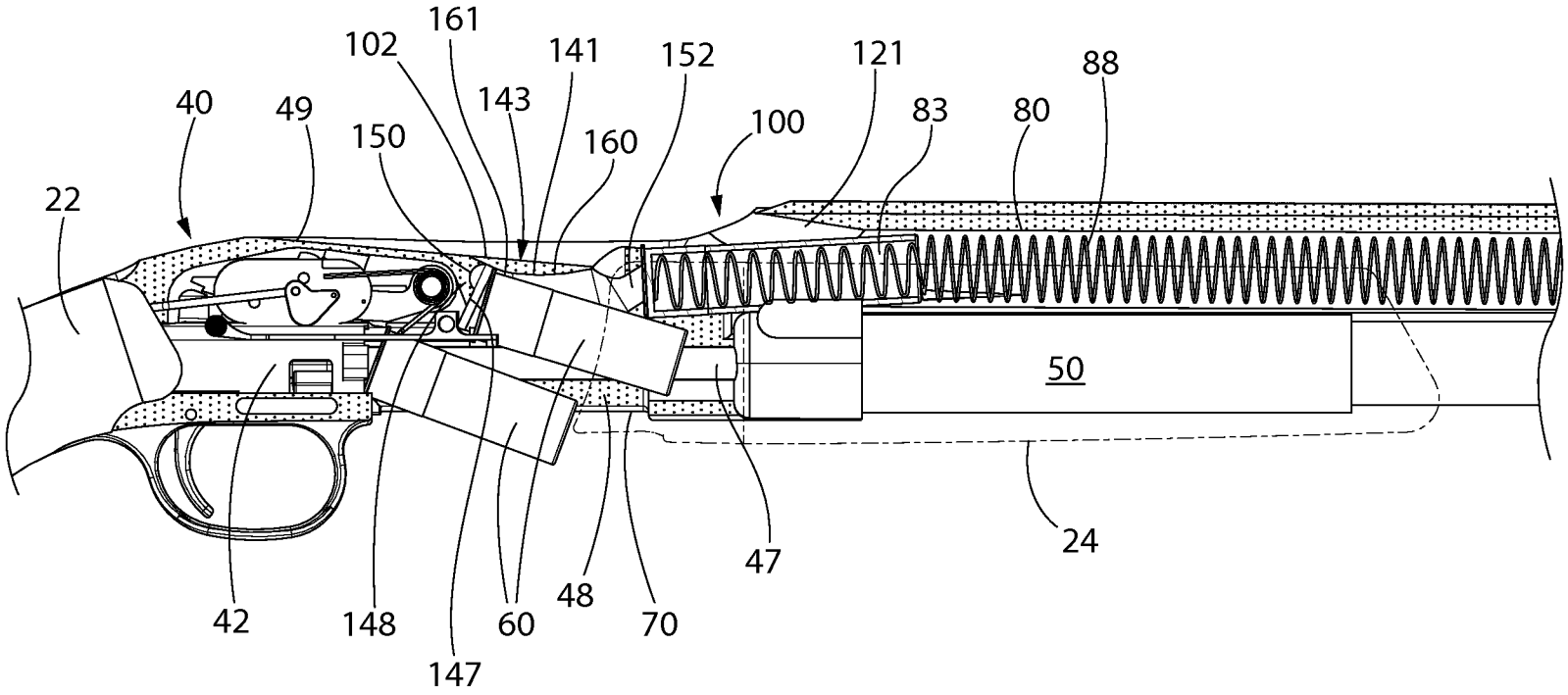

After firing the shotgun 20, the breech re-opens such as by sliding the forearm 24 rearward to cycle action. The extractor 55, which engages the shell rim 64 and withdraws the spent shell 60 from the chamber 53. The rim strikes a surface in the receiver 40 and the shell is ejected downwards and outwards through the ejection port 70, as shown in FIG. 13. In the situation where at least one fresh shell remains in the magazine 80, the shell is fully loaded into the chamber 53 in a similar manner to that described above once the spent shell is out of the way.

It should be noted that a shell loaded into the magazine in the foregoing manner may be automatically advanced through the shell feed system to the position shown and described in FIG. 10 by simply releasing the shell after being loaded into the magazine as in FIGS. 1 and 2. Accordingly, the foregoing shell loading process and movement through the receiver to position the shell to the point where the bolt may engage and chamber the round occurs extremely rapidly in real time.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A shell feeding system for a top loading shotgun, the system comprising:

a barrel defining a longitudinal axis and an axially extending bore forming a projectile pathway;

a receiver supporting the barrel;

an elongated magazine positioned above the barrel and extending axially forward from the receiver;

the magazine including an axially extending cavity configured to receive a plurality of ammunition shells in stacked end-to-end relationship, the shells each having a head and diametrically enlarged rim;

a top loading port for loading shells into the magazine; and shell guide grooves formed by a plurality of internal surfaces in the receiver, the guide grooves including a downwardly and rearwardly angled entrance portion, a central portion, and an exit portion;

wherein the guide grooves are configured to guide and feed each shell in a path downward and rearward in the receiver from the magazine into the central portion, and downward and forward from the central portion towards the barrel;

wherein the central portion has an arcuate shape that engages and rotates the head of the shell upwards.

2. A shell feeding system for a top loading shotgun, the system comprising:

a barrel defining a longitudinal axis and an axially extending bore forming a projectile pathway;

a receiver supporting the barrel;

an elongated magazine positioned above the barrel and extending axially forward from the receiver;

the magazine including an axially extending cavity configured to receive a plurality of ammunition shells in stacked end-to-end relationship, the shells each having a head and diametrically enlarged rim;

a top loading port for loading shells into the magazine;

shell guide grooves formed by a plurality of internal surfaces in the receiver, the guide grooves including a downwardly and rearwardly angled entrance portion, a central portion, and an exit portion; and a spring-biased elongated follower disposed in the magazine that biases the stack of shells rearwards towards the receiver, the follower having a complementary configuration to the shells;

wherein the guide grooves are configured to guide and feed each shell in a path downward and rearward in the receiver from the magazine into the central portion, and downward and forward from the central portion towards the barrel;

wherein the follower has a greater length than the shells.

3. The shell feeding system of claim 2, wherein the follower is configured to maintain contact with a shell as the shell moves through the guide grooves.

4. The shell feeding system of claim 2, wherein the follower is hollow defining an internal cavity, the spring extending into the cavity of the follower.

5. A shell feeding system for a top loading shotgun, the system comprising:

a barrel defining a longitudinal axis and an axially extending bore forming a projectile pathway;

a receiver supporting the barrel;

an elongated magazine positioned above the barrel and extending axially forward from the receiver;

the magazine including an axially extending cavity configured to receive a plurality of ammunition shells in stacked end-to-end relationship, the shells each having a head and diametrically enlarged rim;

a top loading port for loading shells into the magazine; and shell guide grooves formed by a plurality of internal surfaces in the receiver, the guide grooves including a downwardly and rearwardly angled entrance portion, a central portion, and an exit portion;

wherein the guide grooves are configured to guide and feed each shell in a path downward and rearward in the receiver from the magazine into the central portion, and downward and forward from the central portion towards the barrel;

wherein the receiver includes an upper receiver axially aligned with the magazine and a lower receiver axially aligned with the barrel, the guide grooves substantially disposed in the upper receiver.

6. The shell feeding system of claim 1, further comprising a rear abutment surface disposed in the central portion of the guide grooves, the abutment surface arranged to engage the head of the shells and reposition the shells for entry into the exit portion of the guide grooves.

7. A shell feeding system for a top loading shotgun, the system comprising:

a barrel defining a longitudinal axis and an axially extending bore forming a projectile pathway;

a receiver supporting the barrel;

an elongated magazine positioned above the barrel and extending axially forward from the receiver;

the magazine including an axially extending cavity configured to receive a plurality of ammunition shells in stacked end-to-end relationship, the shells each having a head and diametrically enlarged rim;

a top loading port for loading shells into the magazine; and shell guide grooves formed by a plurality of internal surfaces in the receiver, the guide grooves including a downwardly and rearwardly angled entrance portion, a central portion, and an exit portion;

wherein the guide grooves are configured to guide and feed each shell in a path downward and rearward in the receiver from the magazine into the central portion, and downward and forward from the central portion towards the barrel;

wherein the central portion of the guide grooves includes a division wall horizontally separating the loading port from the lower guide groove;

wherein the division wall has a convexly curved bottom surface arranged to engage the shell.

8. A shell feeding system for a top loading shotgun, the system comprising:

a barrel defining a longitudinal axis and an axially extending bore forming a projectile pathway;

a receiver supporting the barrel;

an elongated magazine positioned above the barrel and extending axially forward from the receiver;

the magazine including an axially extending cavity configured to receive a plurality of ammunition shells in stacked end-to-end relationship, the shells each having a head and diametrically enlarged rim;

a top loading port for loading shells into the magazine; and shell guide grooves formed by a plurality of internal surfaces in the receiver, the guide grooves including a downwardly and rearwardly angled entrance portion, a central portion, and an exit portion;

wherein the guide grooves are configured to guide and feed each shell in a path downward and rearward in the receiver from the magazine into the central portion, and downward and forward from the central portion towards the barrel;

wherein the magazine has a tubular body and a bell mouth shaped rear entrance.

9. The shell feeding system of claim 1, wherein the top loading port includes an inclined shell loading ramp.

10. The shell feeding system of claim 1, wherein the magazine is formed as an integral unitary structural part of the receiver.

* * * * *